US010991500B2

(12) United States Patent
Ohtsubo

(10) Patent No.: US 10,991,500 B2
(45) Date of Patent: Apr. 27, 2021

(54) INDUCTOR COMPONENT AND METHOD FOR MANUFACTURING SAME

(71) Applicant: Panasonic Intellectual Property Management Co., Ltd., Osaka (JP)

(72) Inventor: Mutsuyasu Ohtsubo, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 253 days.

(21) Appl. No.: 16/084,785

(22) PCT Filed: Apr. 20, 2017

(86) PCT No.: PCT/JP2017/015811

§ 371 (c)(1),
(2) Date: Sep. 13, 2018

(87) PCT Pub. No.: WO2017/188102

PCT Pub. Date: Nov. 2, 2017

(65) Prior Publication Data

US 2019/0088397 A1 Mar. 21, 2019

(30) Foreign Application Priority Data

Apr. 27, 2016 (JP) ..... JP2016-089329
May 11, 2016 (JP) ..... JP2016-095018

(51) Int. Cl.
*H01F 27/24* (2006.01)
*H01F 17/04* (2006.01)
(Continued)

(52) U.S. Cl.
CPC ..... *H01F 17/04* (2013.01); *H01F 27/24* (2013.01); *H01F 27/255* (2013.01);
(Continued)

(58) Field of Classification Search
CPC .... H01F 17/04; H01F 27/324; H01F 41/0246; H01F 27/292; H01F 27/2828;
(Continued)

(56) References Cited

U.S. PATENT DOCUMENTS 4,595,901 A * 6/1986 Yahagi ..... H01F 17/045 336/192
6,137,390 A * 10/2000 Tung ..... H01F 27/022 336/83
(Continued)

FOREIGN PATENT DOCUMENTS

CN 102568779 A 7/2012
CN 104465021 A 3/2015
(Continued)

OTHER PUBLICATIONS

International Search Report of PCT application No. PCT/JP2017/015811 dated Jul. 25, 2017.
(Continued)

*Primary Examiner* — Tuyen T Nguyen
(74) *Attorney, Agent, or Firm* — McDermott Will and Emery LLP

(57) ABSTRACT

An inductor component includes a coil, a magnetic core, a first terminal, and a second terminal. The coil is made of a wound conductive wire. The coil is embedded in the magnetic core made of magnetic metal powder and insulation resin binder. The magnetic core has a bottom surface, a top surface opposite to the bottom surface, a first side surface which is perpendicular to the bottom surface and is connected with the bottom surface and the top surface, a second side surface opposite to the first side surface, a third side surface connected with the first side surface and the second side surface, and a fourth side surface opposite to the third side surface. The first terminal and the second terminal extend from both ends of the coil and protrude from the
(Continued)

bottom surface. A line along the bottom surface extending from a position at which the first terminal protrudes to a position at which the second terminal protrudes is longer than a straight line extending from the position at which the first terminal protrudes to the position at which the second terminal protrudes.

12 Claims, 25 Drawing Sheets

(51) Int. Cl.

| | |
|---|---|
| ***H01F 27/255*** | (2006.01) |
| ***H01F 27/32*** | (2006.01) |
| ***H01F 41/02*** | (2006.01) |
| ***H01F 27/29*** | (2006.01) |
| ***H01F 27/28*** | (2006.01) |
| ***H01F 41/12*** | (2006.01) |
| ***H01F 37/00*** | (2006.01) |
| ***H01F 41/04*** | (2006.01) |

(52) U.S. Cl.
CPC ..... *H01F 27/2828* (2013.01); *H01F 27/292* (2013.01); *H01F 27/324* (2013.01); *H01F 37/00* (2013.01); *H01F 41/0246* (2013.01); *H01F 41/04* (2013.01); *H01F 41/125* (2013.01); *H01F 2017/048* (2013.01); *H01F 2027/297* (2013.01)

(58) Field of Classification Search
CPC ..... H01F 41/125; H01F 27/255; H01F 37/00; H01F 41/04; H01F 2017/048; H01F 2027/297
See application file for complete search history.

(56) References Cited

U.S. PATENT DOCUMENTS

| | | | |
|---|---|---|---|
| 2006/0009000 | A1 | 1/2006 | Shiu et al. |
| 2008/0276447 | A1 | 11/2008 | Hsueh et al. |
| 2014/0320256 | A1 | 10/2014 | Inaba |

FOREIGN PATENT DOCUMENTS

| | | |
|---|---|---|
| JP | 2006-024947 | 1/2006 |
| JP | 2008-258234 | 10/2008 |
| JP | 2009-295759 | 12/2009 |
| JP | 2010-010426 | 1/2010 |
| JP | 2011-187776 | 9/2011 |
| JP | 2013-026478 | 2/2013 |
| JP | 2013-128099 | 6/2013 |
| JP | 2013-258285 | 12/2013 |
| JP | 2015-216247 | 12/2015 |
| JP | 5891344 B2 | 3/2016 |

OTHER PUBLICATIONS

English Translation of Chinese Search Report dated Nov. 25, 2020 for the related Chinese Patent Application No. 201780024679.X.

* cited by examiner

INDUCTOR COMPONENT AND METHOD FOR MANUFACTURING SAME

CROSS-REFERENCE TO RELATED APPLICATIONS

This application is a U.S. national stage application of the PCT international application No. PCT/JP2017/015811 filed on Apr. 20, 2017, which claims the benefit of foreign priority of Japanese patent applications No. 2016-089329 filed on Apr. 27, 2016 and No. 2016-095018 filed on May 11, 2016, the contents all of which are incorporated herein by reference.

TECHNICAL FIELD

The present disclosure relates to an inductor component used in various electronic devices and to a method for manufacturing the inductor component.

BACKGROUND ART

Electronic devices are increasingly sophisticated and downsized, and higher frequencies, such as several hundred kilohertz for drive frequencies and a larger capacitance of several ten to several hundred amperes for output, have been adopted in a drive power supply, such as a DC-DC converter, for driving these electronic devices.

Accordingly, inductor components used in these driver power supplies need to adopt a high-frequency magnetic core with low eddy current loss, and high saturation magnetic flux density that will not easily reach magnetic saturation against large current.

For this purpose, magnetic metal powder made of iron or alloy mainly composed of iron with high saturation magnetic flux density in soft magnetic materials is mixed with an insulation resin binder for binding particles of magnetic metal powder to produce granulated powder, and pressure-molded to have a predetermined shape for use as the magnetic core.

In this magnetic core, losses are reduced by shortening a flow length of eddy current in particles by adopting powder of metal magnetic substance. Since the binder made of insulation resin covers particles of magnetic metal powder, an increase of loss due to eddy current flow among particles is prevented to support higher frequencies and larger current.

A downsized inductor component is provided by embedding a coil having a wound conductive wire inside this magnetic core.

A conventional inductor component including a coil embedded inside a magnetic core is shown in FIG. 26. FIG. 26 is a perspective view of the conventional inductor component, and a portion inside the magnetic core is indicated with broken line.

As shown in FIG. 26, conventional inductor component 1 includes body 2 having a rectangular columnar shape, coil 3 having a spirally-wound and insulation-covered conductive wire embedded in body 2, and terminals 4 protruding outward from both ends of coil 3 from the same surface of body 2. The terminals protruding outward from the same surface of body 2 support through-hole mounting on a mounting board.

Body 2 is formed by mixing and pressure-molding magnetic metal powder made of metal magnetic substance mainly made of iron and binder made of insulating epoxy resin. Body 2 acts as magnetic core 5 of inductor component 1 constituting a closed magnetic path by embedding coil 3.

Body 2 is manufactured with a mold die set including a die unit (not illustrated) having a plate shape that has therein a vertical through-hole with rectangular cross section, a lower punch (not illustrated) having a bar shape below the die unit that can be inserted in the through-hole in the die unit, and an upper punch having a bar shape above the die unit that can be inserted in the through-hole in the die unit. A cavity for forming the shape of body 2 is a space surrounded by the die unit, the lower punch, and the upper punch by inserting the lower punch and the upper punch into the through-hole in the die unit.

The lower punch is partially inserted into the through-hole in the die unit of the mold, and coil 3 and the mixture of magnetic metal powder and the binder fills the cavity. When filling the cavity, both ends of coil 3 constituting terminals 4 protrude outward from one inner wall of the through-hole in the die unit to outside the cavity.

In order to allow terminal 4 to protrude outside the cavity, the die unit is previously divided into a lower die and an upper die. A recess for fitting terminal 4 is provided in a parting surface of the lower die and upper die since it is difficult to make terminal 4 protrude on the pressing face of the upper punch and the lower punch. Terminal 4 protrudes outside the cavity when the lower die and upper die are filled and clamped.

Next, the lower punch and upper punch are pressurized with a predetermined pressure.

Then, the mold die set is opened to take out a molded piece. Thermal treatment is applied to the molded piece obtained to thermally cure epoxy resin and complete the inductor component.

CITATION LIST

Patent Literature

PTL1: Japanese Patent Laid-Open Publication No. 2008-258234

SUMMARY

The present disclosure aims to offer an inductor component with improved withstand voltage between terminals of the inductor component by increasing electric resistance between the terminals of the inductor component in which a coil is embedded inside a magnetic core to support through-hole mounting.

The inductor component of the present disclosure includes a coil, a magnetic core, a first terminal, and a second terminal. The coil is made of a wound conductive wire. The magnetic core is made of magnetic metal powder and insulation resin binder. The coil is embedded in the magnetic core. The magnetic core has a bottom surface, a top surface opposite to the bottom surface, a first side surface which is perpendicular to the bottom surface and which is connected with the bottom surface and the top surface, a second side surface opposite to the first side surface, a third side surface connected with the first side surface and the second side surface, and a fourth side surface opposite to the third side surface. The first terminal and the second terminal extend from both ends of the coil, and protrude from the bottom surface. A line along the bottom surface extending from a position at which the first terminal protrudes to a position at which the second terminal protrudes is longer than a straight line extending from the position at which the first terminal protrudes to the position at which the second terminal protrudes.

The above configuration increases a creeping length on the bottom surface between the terminals to increase electric resistance on the surface, accordingly improving insulation withstand voltage.

DETAIL DESCRIPTION OF PREFERRED EMBODIMENTS

Figure 26:
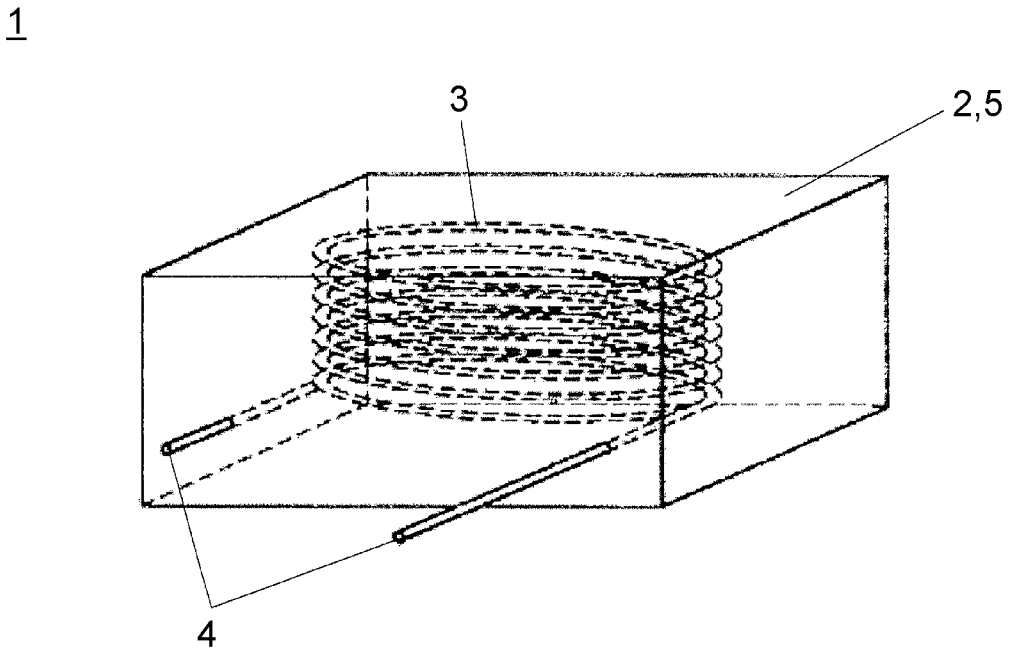
FIG. 26 Prior Art
FIG. 26 is a perspective view of a conventional inductor component.

Prior to description of exemplary embodiments of the present disclosure, a disadvantage of an inductor component shown in FIG. 26 is briefly described. In a structure of the inductor component shown in FIG. 26 and its manufacturing method, a surface of main body 2 from which terminal 4 protrudes is molded by an inner wall of a die unit of a mold die set. Therefore, the surface of main body 2 from which terminal 4 protrudes is rubbed against the inner wall of the die unit when the mold is opened to take out the molded piece. This operation makes a binder covering the surface of magnetic metal powder rubbed against the inner wall of the through-hole of the die unit and causes partial damage. This may decreases electric resistance of a surface of the main body between terminals.

In inductor component 1 including coil 3 embedded inside magnetic core 5, insulation withstand voltage between terminals 4 protruding from the same surface of main body 2 cannot be increased when through-hole mounting is adopted. An operating voltage of a circuit board with inductor component 1 is thus limited.

Exemplary embodiments will be detailed below with reference to drawings. The exemplary embodiments below are all examples of the present disclosure. Numeric values, shapes, materials, components, positions and connection styles of the components, steps, and step sequence of the exemplary embodiments do not limit the scope of the present disclosure in anyway.

First Exemplary Embodiment

An inductor component in accordance with the first exemplary embodiment of the present disclosure will be described below with reference to drawings.

Figure 1:
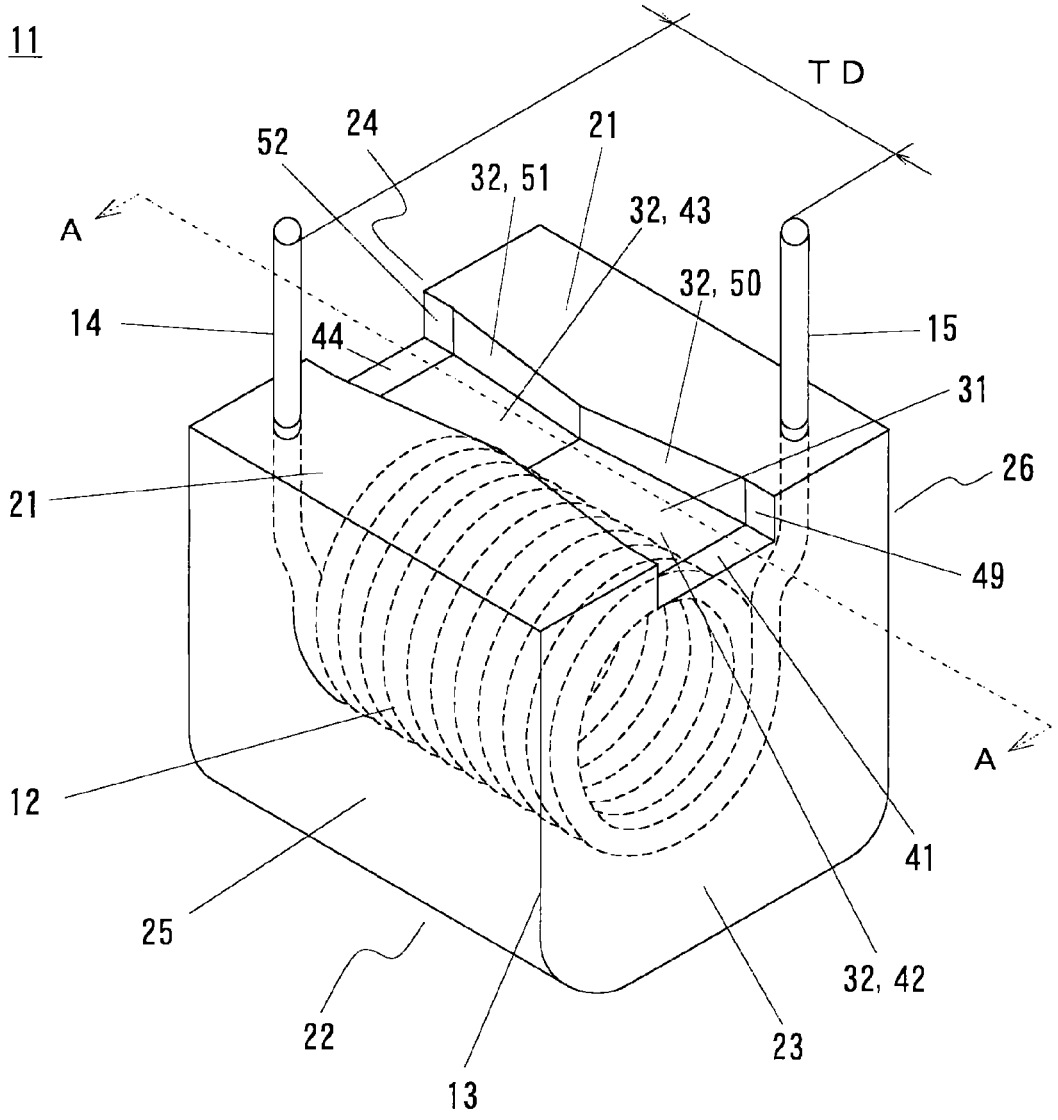
FIG. 1 is a perspective view of an inductor component in accordance with a first exemplary embodiment of the present disclosure seen from a bottom surface of the inductor component.

FIG. 1 is a perspective view of the inductor component in accordance with the first exemplary embodiment of the present disclosure seen from a bottom surface of the inductor component.

As shown in FIG. 1, inductor component 11 in accordance with the first exemplary embodiment of the present disclosure includes coil 12 including a would conductive wire, magnetic core 13 having coil 12 embedded therein, first terminal 14, and second terminal 15. First terminal 14 and second terminal 15 are terminals for through-hole mounting that extend in the same direction, protrude from the same surface of magnetic core 13 in the same direction, and are inserted into through-holes of a mounting board (not illustrated) to be connected to an electric circuit.

Coil 12 is formed by spirally winding a conductive wire made of copper with insulation coating, such as enamel and polyamide-imide resin, and is hollow around a winding axis. The conductive wire is a thick copper conductive wire with a diameter of about ϕ0.8 mm to ϕ1.6 mm to flow a large current of electronic devices. In accordance with the exemplary embodiment, the conductive wire with a diameter of ϕ1.2 mm is wound by 11 turns.

Magnetic core 13 is made of a mixture of an iron base magnetic metal powder and insulation resin binder. Coil 12 is embedded inside magnetic core 13, and magnetic core 13 is pressure-molded to form magnetic core 13.

Magnetic core 13 enters the hollow of the winding axis of coil 12 and densely covers an outer periphery of coil 12 to constitute a closed magnetic path of inductor component 11 as magnetic core 13 and also a casing, i.e., a main body, of inductor component 11.

The magnetic metal powder out of the magnetic metal powder and the binder of magnetic core 13 is iron or iron base metal magnetic substance with high saturated magnetic flux density in soft magnetic materials, such as iron-nickel alloy, iron-silicon alloy, iron-silicon-aluminum alloy, and iron-silicon-chromium alloy. Powder of the metal magnetic substance is formed by grinding or atomizing methods.

The binder covers particles of magnetic metal powder and is interposed between the particles to bond the particles and insulate the particles from eddy current so as to suppress an increase of an eddy current loss in magnetic core 13. The binder is made of insulation thermosetting resin, such as epoxy resin and silicone resin, to insulate between the particles by being mixed with the magnetic metal powder. By thermal treatment after pressure-molding, the binder is thermoset to bond the particles.

As described above, the powder of metal magnetic substance with high saturated magnetic flux density and providing the binder between the particles, decreases a length of eddy current flowing in magnetic core 13 to prevent an increase of eddy current loss. Accordingly, the inductor component can be applied to high frequencies and large current.

This magnetic core 13 includes bottom surface 21, top surface 22 opposite to bottom surface 21, first side surface 23 which is perpendicular to bottom surface 21 and is connected with bottom surface 21 and top surface 22 at one side of the winding axis direction of coil 12, second side surface 24 opposite to first side surface at the other side of the winding axis direction of coil 12, third side surface 25 connected with first side surface 23 and second side surface 24, and fourth side surface opposite to third side surface 25. In accordance with the exemplary embodiment, magnetic core 13 has substantially a rectangular-columnar shape with outer dimensions of 18.0 mm×18.0 mm×18.0 mm.

Magnetic core 13 is formed with a mold die set. This mold die set includes a die unit including an upper die and a lower die, a lower punch provided below the die unit, and an upper punch provided above the die unit. The die unit has a through-hole in an up-down direction (upper direction is the first direction). The lower punch has a bar shape configured to be inserted in the through-hole of the die unit. The upper punch has a bar shape configured to be inserted into the through-hole of the die unit. The mold die set produces a cavity surrounded by the die unit, the upper punch, and the lower punch. Magnetic core 13 is formed by pressure-molding, in the cavity, a granulated mixture of the magnetic metal powder and the binder having coil 12 embedded therein.

Bottom surface 21, top surface 22, third side surface 5, and fourth side surface 26 of magnetic core 13 are molded by inner walls of the through-hole in the die unit. First side surface 23 of magnetic core 13 is molded by a pressing surface of the lower punch. Second side surface 24 opposite to first side surface 23 is molded by a pressing surface of the upper punch.

First terminal 14 and second terminal 15 are formed by extending both ends of the conductive wire of coil 12 in the same direction and protruding outside the cavity of the mold from bottom surface 21 of magnetic core 13 in the same direction. Insulation coating of the conductive wire is removed at first terminal 14 and second terminal 15 to complete the inductor component for through-hole mount.

Inductor component 11 in accordance with the first exemplary embodiment of the present disclosure has recess 31 in bottom surface 21 between first terminal 14 and second terminal 15. Recess 31 extends from first side surface 23 to second side surface 24.

This configuration increases a creeping length on bottom surface 21 between first terminal 14 and second terminal 15 to increase electric resistance of the surface between first terminal 14 and second terminal 15. Accordingly, insulation withstand voltage between first terminal 14 and second terminal 15 can be improved.

Figure 2:
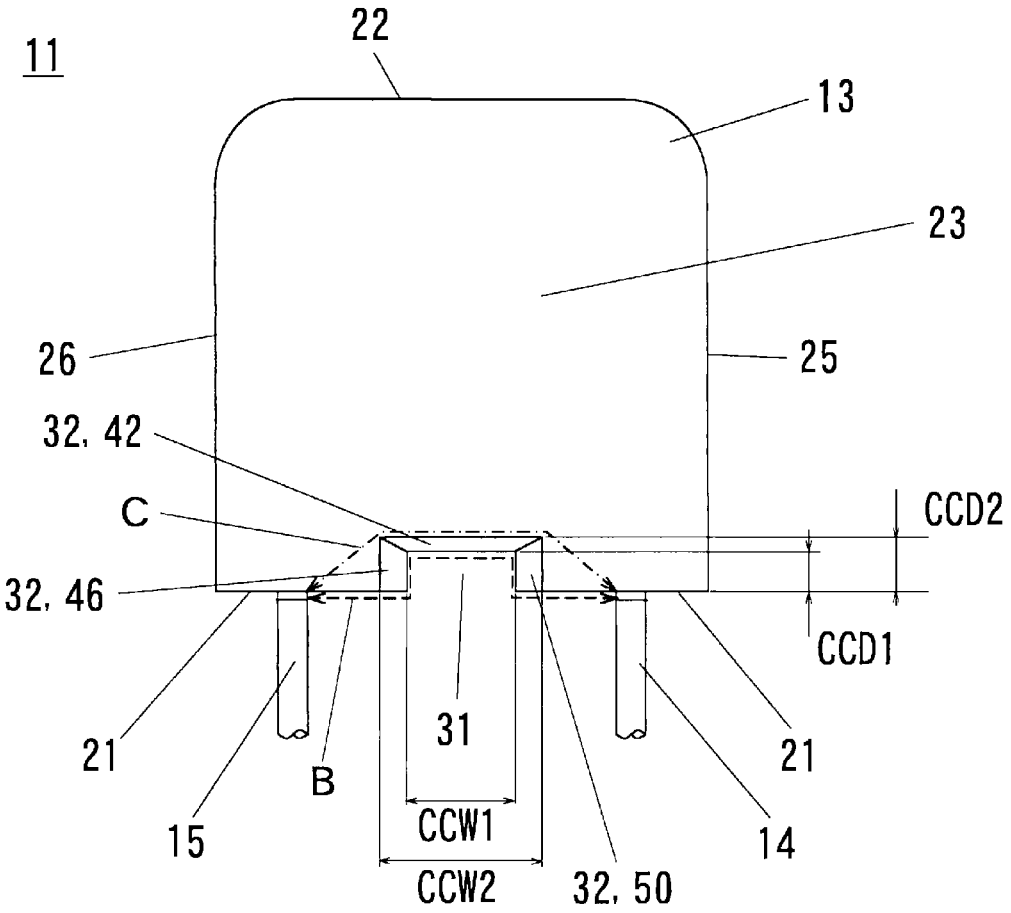
FIG. 2 is a plan view of the inductor component in accordance with the first exemplary embodiment of the present disclosure seen from a first side surface of the inductor component.

FIG. 2 is a side view of inductor component 11 in accordance with the first exemplary embodiment of the present disclosure seen from first side surface 23. A creeping length between first terminal 14 and second terminal 15 is indicated as broken line B. The creeping length between first terminal 14 and second terminal 15 is a length of a line from a position at which first terminal 14 protrudes along the surface of bottom surface 21 toward second terminal 15 to a position at which second terminal 15 protrudes, across an inner surface of recess 31 and the surface of bottom surface 21 on the opposite side. The creeping length between first terminal 14 and second terminal 15 is reliably longer than a creeping length between both terminals 4 of the conventional inductor component in FIG. 26 that is linearly connected with positions at which both terminals protrude due to recess 31 from first side surface 23 to second side surface 24 in accordance with the exemplary embodiment. This configuration can increase electric resistance of the surface between first terminal 14 and second terminal 15, accordingly improving insulation withstand voltage between first terminal 14 and second terminal 15.

In addition, the shortest length inside magnetic core 13 between the positions at which first terminal 14 and second terminal 15 protrude, as shown by dot-and-dash line C shown in FIG. 2, is from the position at which first terminal 14 protrudes to the bottom of recess 31 and from the bottom of recess 31 to the position at which second terminal 15 protrudes. The shortest length inside magnetic core 13 can also be long in accordance with the exemplary embodiment, compared to the shortest length inside main body 2 between both terminals 4 of the conventional inductor component 1 shown in FIG. 26, i.e., a length in a straight line between the positions at which terminals 4 protrude.

The creeping length between first terminal 14 and second terminal 15 inside magnetic core 13 can be thus longer to improve insulation withstand voltage.

As described above, in accordance with the exemplary embodiment, electric resistance can be increased both on the surface of magnetic core and inside magnetic core 13 between first terminal 14 and second terminal 15, so as to improve insulation withstand voltage.

In a direction connecting between first side surface 23 and second side surface 24, second terminal 15 out of first terminal 14 and second terminal 15 protruding from bottom surface 21 is disposed at a side to first side surface 23 with respect to the center of bottom surface 21, and first terminal 14 out of first terminal 14 and second terminal 15 protruding from bottom surface 21 is disposed at a side to second side surface 24 with respect to the center of bottom surface 21. Length TD (see FIG. 1) separates first terminal 14 and second terminal 15 away from each other is preferably provided from the center of bottom surface 21 toward each of first side surface 23 and second side surface 24.

This configuration increases the creeping length between first terminal 14 and second terminal 15 to increase electric resistance of the surface, and therefore, improves insulation withstand voltage between first terminal 14 and second terminal 15.

In this case, first terminal 14 and second terminal 15 are preferably separated from each other symmetrically to each other with respect to the center of bottom surface 21. Second terminal 15 is preferably disposed on a corner area formed by first side surface 23 and fourth side surface 26 while first terminal 14 is preferably disposed on a corner area formed by second side surface 24 and third side surface 25.

This configuration increases the creeping length between first terminal 14 and second terminal 15 to improve insulation withstand voltage between first terminal 14 and second terminal 15. In addition, since first terminal 14 and second terminal 15 are provided at positions symmetrically to each other with respect to the center of bottom surface 21, first terminal 14 and second terminal 15 can balance a load applied to each terminal when through-hole mounted on a mounting board.

Furthermore, inductor component 11 in accordance with the first exemplary embodiment of the present disclosure has high resistance area 32 on the inner surface of recess 31. High resistance area 32 has surface electric resistance higher than that in an area of bottom surface 21 other than recess 31.

First, the shape of recess 31 will be detailed below with respect to this high resistance area 32.

Figure 3:
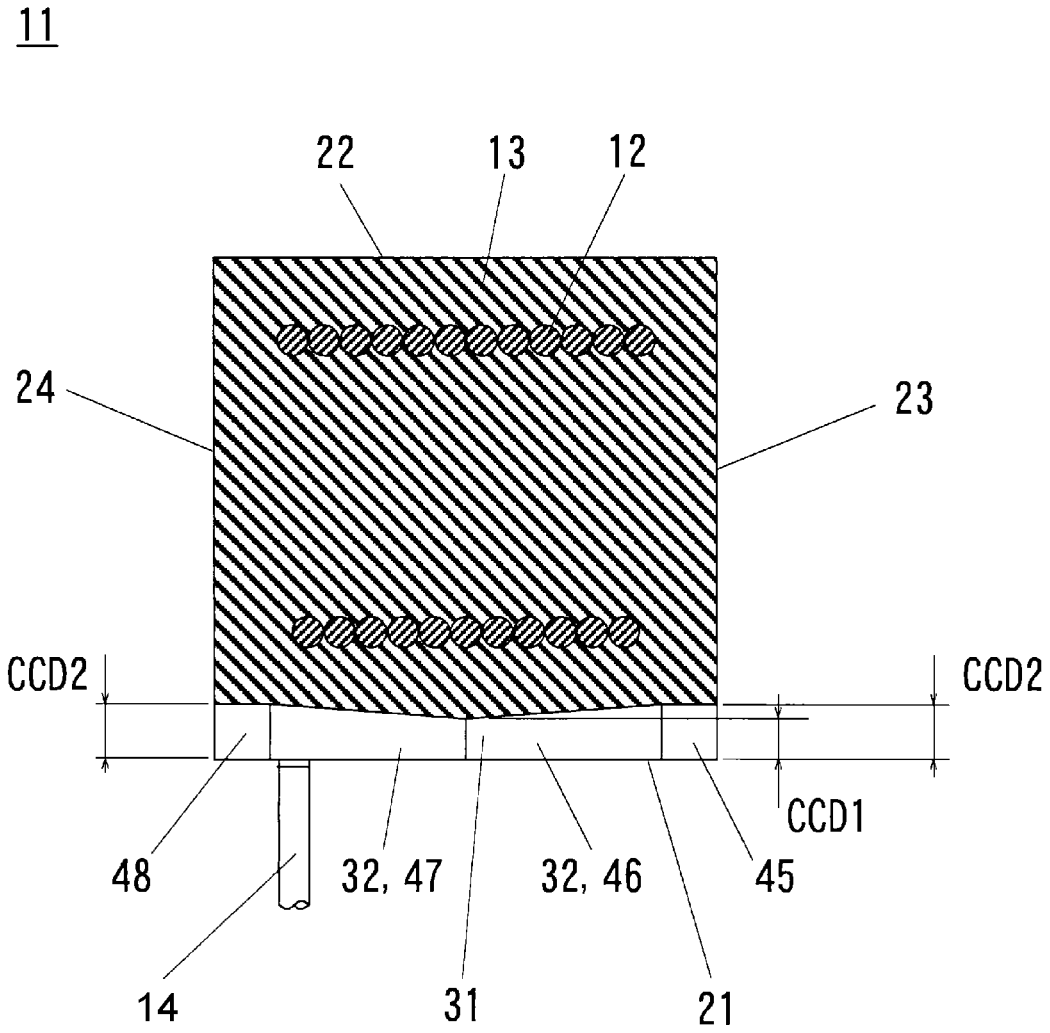
FIG. 3 is a sectional view of the inductor component along line A-A shown in FIG. 1.
Figure 4:
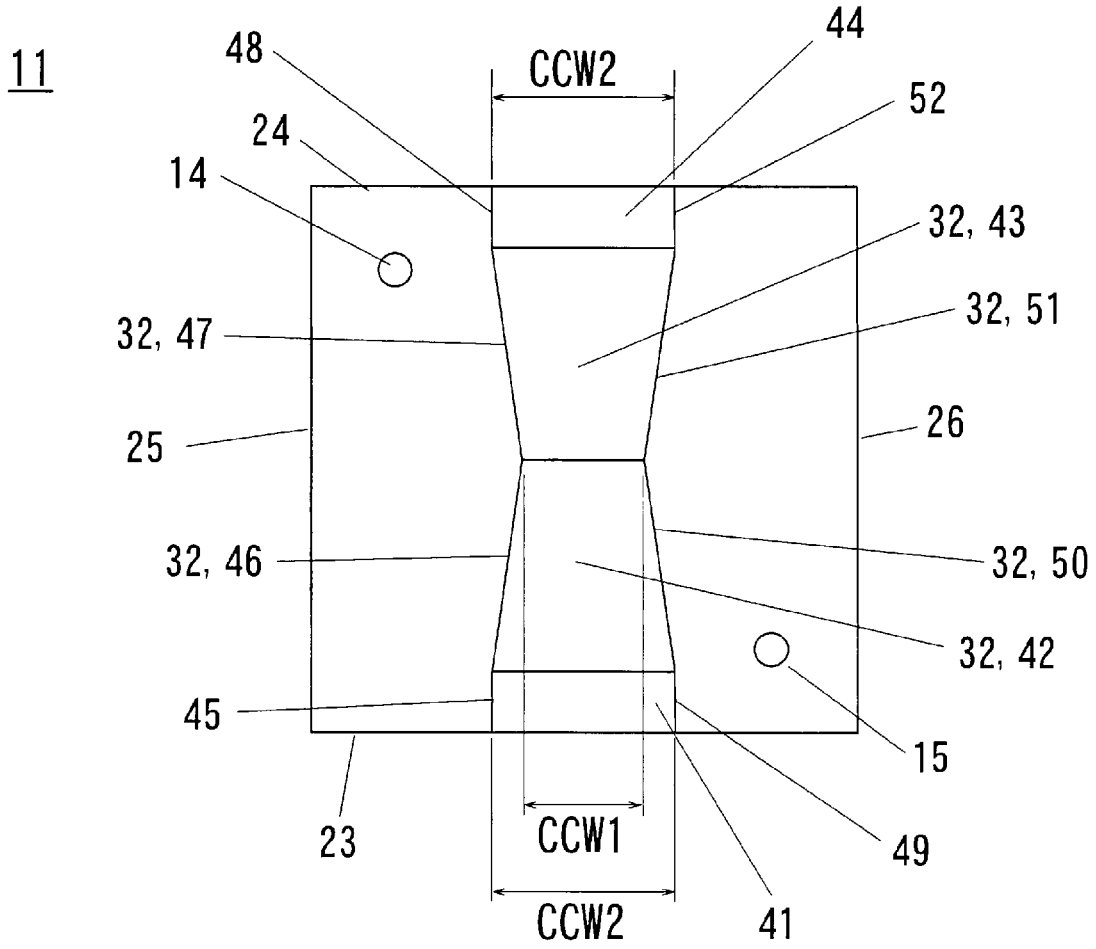
FIG. 4 is a plan view of the inductor component in accordance with the first exemplary embodiment of the present disclosure seen from the bottom surface of the inductor component.

FIG. 3 is a sectional view of the inductor component along line A-A shown in FIG. 1, and FIG. 4 is a plan view of the inductor component seen from the bottom.

As shown in FIG. 3 and FIG. 4, recess 31 has a rectangular cross section perpendicular to a direction connected between first side surface 23 and second side surface 24. An inner bottom surface of recess 31 out of inner surfaces configuring recess 31 at a side to top surface 22 includes first recess inner bottom surface 41, second recess inner bottom surface 42, third recess inner bottom surface 43, and fourth recess inner bottom surface 44. First recess inner bottom surface 41 extends from first side surface 23 to an outer end of second terminal 15 closer to first side surface 23. Second recess inner bottom surface 42 is connected with first recess inner bottom surface 41, and forms the inner bottom surface from first recess inner bottom surface 41 to the center of bottom surface 21. Third recess inner bottom surface 43 is connected with second recess inner bottom surface 42, and forms the inner bottom surface from second recess inner bottom surface 42 to an outer end of first terminal 14 closer to second side surface 24. Fourth recess inner bottom surface 44 is connected with third recess inner bottom surface 43, and forms the inner bottom surface from third recess inner bottom surface 43 to second side surface 24.

The inner side surface of recess 31 out of the inner surfaces configuring recess 31 at a side to third side surface 25 includes first recess inner side surface 45, second recess inner side surface 46, third recess inner side surface 47, and fourth recess side inner surface 48. First recess inner side surface 45 forms an inner side surface from first side surface 23 to the outer end of second terminal 15 at a side to first side surface 23. Second recess inner side surface 46 forms the inner side surface from first recess inner side surface 45 to the center of bottom surface 21. Third recess inner side surface 47 forms the inner side surface from second recess inner side surface 46 to the outer end of first terminal 14 at a side to second side surface 24. Fourth recess side inner surface 48 forms the inner side surface from third recess inner side surface 47 to second side surface 24.

The inner side surface of recess 31 out of the inner surfaces configuring recess 31 at a side to fourth side surface 26 includes fifth recess inner side surface 49, sixth recess inner side surface 50, seventh recess inner side surface 51, and eighth inner side surface 52. Fifth recess inner side surface 49 forms the inner side surface from first side surface 23 to the outer end of second terminal 15 at a side to first side surface 23. Sixth recess inner side surface 50 forms the inner side surface from fifth recess inner side surface 49 to the center of bottom surface 21. Seventh recess inner side surface 51 forms the inner side surface from sixth recess inner side surface 50 to the outer end of first terminal 14 at a side to second side surface 24. Eighth inner side surface 52 forms the inner side surface from seventh recess inner side surface 52 to second side surface 24.

Depth CCD of an area of recess 31 surrounded by second recess inner bottom surface 42, second recess inner side surface 46, and sixth recess inner side surface 50 increases from depth CCD1 to depth CCD2 as shifting toward first side surface 23 from the center of bottom surface 21 between first side surface 23 and second side surface 24. Width CCW of recess 31 accordingly increases from width CCW1 to width CCW2.

Depth CCD of an area of recess 31 surrounded by third recess inner bottom surface 43, third recess inner side surface 47, and seventh recess inner side surface 51 increases from depth CCD1 to depth CCD2 as shifting toward second side surface 24 from the center of bottom surface 21 between first side surface 23 and second side surface 24. Width CCW of recess 31 accordingly increases from width CCW1 to width CCW2.

An area of recess 31 surrounded by first recess inner bottom surface 41, first recess inner side surface 45, and fifth recess inner side surface 49 is connected with the area of recess 31 surrounded by second recess inner bottom surface 42, second recess inner side surface 46, and sixth recess inner side surface 50. In the area of recess 31 surrounded by first recess inner bottom surface 41, first recess inner side surface 45, and fifth recess inner side surface 49, each of depths of recess 31 at the center of bottom surface 21 and first side surface 23 is depth CCD2. In this area, each of widths of recess at to the center of bottom surface 21 and first side surface 23 is width CCW2.

An area surrounded by fourth recess inner bottom surface 4, fourth recess inner side surface 48, and eighth recess side surface 52 is connected with the area surrounded by third recess inner bottom surface 43, third recess inner side surface 47, and seventh recess inner side surface 51. In the area surrounded by fourth recess inner bottom surface 4, fourth recess inner side surface 48, and eighth recess side surface 52, each of depths of recess 31 at the center of bottom surface 21 and second side surface 24 is depth CCD2. In this area, each of widths of recess 31 to the center of bottom surface 21 and second side surface 24 is width CCW2.

This configuration of recess 31 causes part of the binder covering particles of magnetic metal powder at bottom surface 21 other than recess 31 tends to get damaged due to being rubbed against the upper die and the lower die when the upper die and the lower die of the die unit are opened to take out molded magnetic core 13 from the die unit of the mold die set. On the other hand, second recess inner bottom surface 42, second recess inner side surface 46, sixth recess inner side surface 50, third recess inner bottom surface 43, third recess inner side surface 47, and seventh recess inner side surface 51 are not rubbed against the upper die or the lower die. This configuration can eliminate damage to the binder-coated particles of metal magnetic power. Accordingly, an area with electric resistance higher than the surface of bottom surface 21 other than recess 31 can be provided in the above areas in the inner surface of recess 31.

Since a path of the creeping length between first terminal 14 and second terminal 15 passes this area with high electric resistance on the surface, insulation withstand voltage between first terminal 14 and second terminal 15 can be increased.

Here, depth CCD of recess 31 in the area at the side of first side surface 23 surrounded by first recess inner bottom surface 41, first recess inner side surface 45, and fifth recess inner side surface 49 and the area at the side of second side surface 24 surrounded by fourth recess inner bottom surface 44, fourth recess inner side surface 48, and eighth recess inner side surface 52 is retained to depth CCD2. Width CCW of recess 31 in these areas is retained to width CCW2 so that first recess inner bottom surface 41 and fourth recess inner bottom surface 44 preferably become parallel to bottom surface 21 of magnetic core 13. In addition, in the above areas, first recess inner side surface 45, fifth recess inner side surface 49, fourth recess inner side surface 48, and eighth recess inner side surface 52 are preferably parallel to a direction connected between first side surface 23 and second side surface 24 of magnetic core 13.

This configuration prevents burring on first side surface 23 and second side surface 24 of magnetic core 13 even if dimensional variations occur in a length between the upper punch and the lower punch, i.e., a dimension between first side surface 23 and second side surface 24 of magnetic core 13 while pressure-molding magnetic core 13 with the mold die set.

The exemplary embodiment provides an example of the increasing of depth CCD of recess 31 and width CCW of recess 31 from the center of magnetic core 13 toward first side surface 23 and from the center of magnetic core 13 toward second side surface 24. However, the parting surface of the upper die and the lower die of the mold die set may be changed to have, for example, depth CCD1 smaller than depth CCD and width CCW1 smaller than width CCW in the area of recess 31 surrounded by first recess inner bottom surface 41, first recess inner side surface 45, and fifth recess inner side surface 49. Depth CCD of recess 31 may have larger depth CCD2, and width CCW may have larger width CCW2 toward the area of recess 31 surrounded by fourth recess inner bottom surface 44, fourth recess inner side surface 48, and eighth recess inner side surface 52. This configuration also provides the same effect as the exemplary embodiment.

A cross section of recess 31 has a rectangular shape in the description, but the shape is not limited to the rectangular shape. The cross section may have curved sides, providing the same effect.

In the description, high resistance area 32 of the inner surface of recess 31 with high electric resistance is formed on the inner surface of the area surrounded by second recess inner bottom surface 42, second recess inner side surface 46, and sixth recess inner side surface 50, and formed on the inner surface of the area surrounded by third recess inner bottom surface 43, third recess inner side surface 47, and seventh recess inner side surface 51. However, high resistance area 32 may be provided on a part of recess 31 as long as high resistance area 32 is formed on a path of creeping length connected from first terminal 14 to second terminal 15 and electric resistance between first terminal 14 and second terminal 15 is high. Accordingly, the area with high electric resistance is not necessarily formed on second recess inner side surface 46 and seventh recess inner side surface 51 shown in FIG. 4.

Next, a method for manufacturing inductor component 11 in accordance with the first exemplary embodiment of the present disclosure will be described below with reference to FIGS. 5 to 13.

Figure 5:
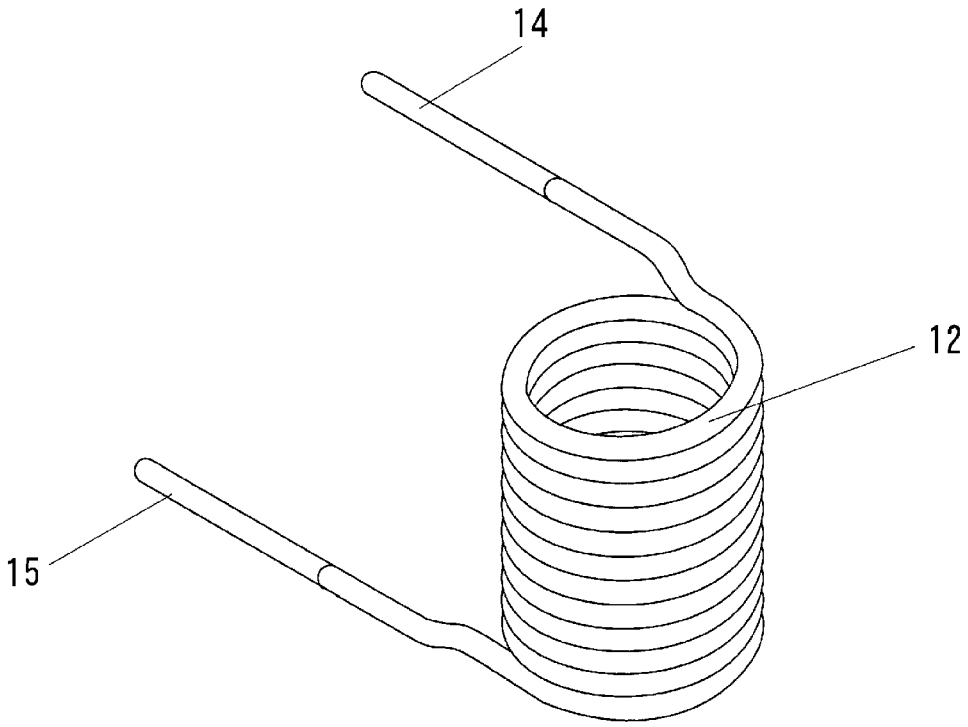
FIG. 5 illustrates a process for manufacturing the inductor component in accordance with the first exemplary embodiment of the present disclosure.

First, coil 12 is formed by winding a conductive wire, as shown in FIG. 5.

Coil 12 is formed by winding a conductive wire, such as copper, with insulation coating of enamel or polyamide-imide around a predetermined winding shaft.

After winding the conductive wire, coil 12 is removed from the winding shaft to form a hollow core in coil 12.

A conductive wire with welded layer having a welded layer on an outer periphery of the insulation film may be used to retain the shape of coil 12.

Next, first terminal 14 and second terminal 15 extending in the same direction from both ends of coil 12 are formed.

First terminal 14 and second terminal 15 are formed by extending both ends of coil 12 in the same direction perpendicular to a direction of the winding axis of the conductive wire, and by removing the insulation film of the conductive wire by a predetermined length required for through-hole mounting of inductor component 11.

Next, magnetic metal powder and insulation resin binder are mixed to provide a mixture thereof, and coil 12 is embedded in this mixture. Then, the mixture is pressure-molded to form magnetic core 13 having bottom surface 21, top surface 22 opposite to bottom surface 21, first side surface 23 perpendicular to bottom surface 21 on one end of the winding axis direction of coil 12 and connected with bottom surface 21 and top surface 22, second side surface 24 opposite to first side surface 23 on the other end of the winding axis direction of coil 12, third side surface 25 connected with first side surface 23 and second side surface 24, and fourth side surface 26 opposite to third side surface 25.

Figure 6:
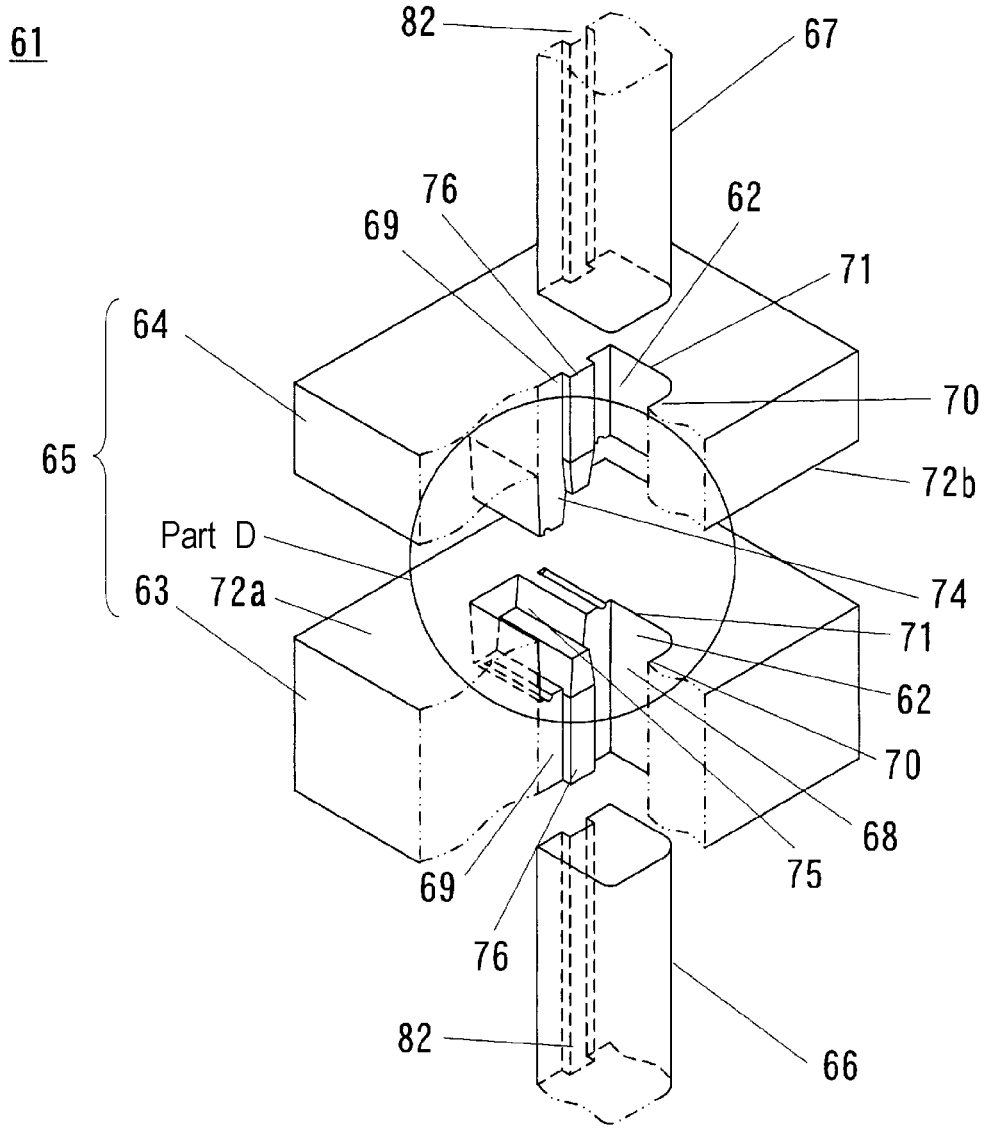
FIG. 6 illustrates a process for manufacturing the inductor component in accordance with the first exemplary embodiment of the present disclosure.
Figure 7:
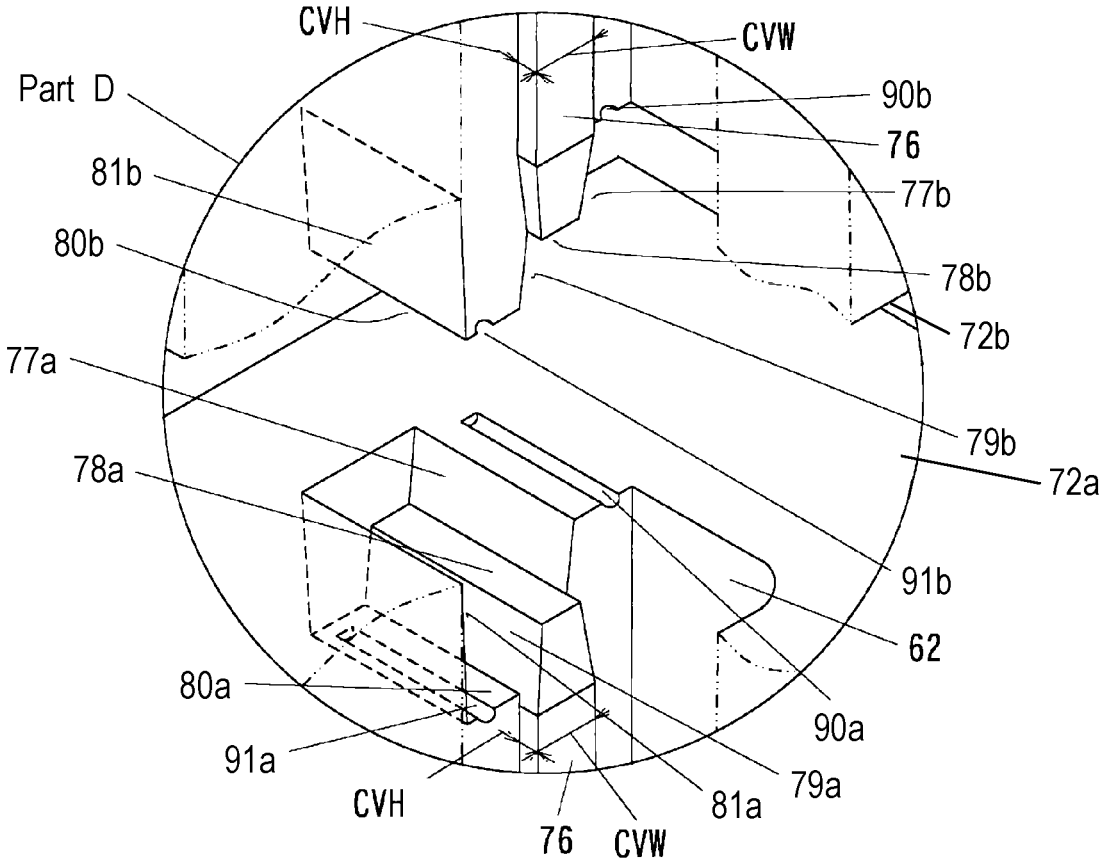
FIG. 7 is an enlarged view of Part D of the inductor component shown in FIG. 6.

Mold die set 61 for pressure-molding magnetic core 13 shown in FIG. 6 and FIG. 7 is prepared. FIG. 7 is an enlarged view of Part D of the mold die set shown in FIG. 6.

Mold die set 61 has through-hole 62 therein in an up-down direction (hereinafter, an upward direction is the first direction), and includes die unit 65, lower punch (first punch) 66 provided below die unit 65, and upper punch (second punch) 67 disposed above die unit 65. Die unit 65 can be separated into lower die (first die) 63 and upper die 64 (second die) upward and downward. Lower punch 66 is inserted slidably into through-hole 62 upward and downward. Upper punch 67 is inserted slidably into through-hole 62 upward and downward.

Cavity 68 constituted by a space surrounded by through-hole 62, lower punch 66, and upper punch in die unit 65 configures the shape of magnetic core 13 so as to mold magnetic core 13.

Magnetic core 13 is pressure-molded by pressing the mixture such that lower punch 66 and upper punch 67 approached each other upward and downward. A top surface of lower punch 66 molds first side surface 23 out of the outer peripheral surface of magnetic core 13, and a bottom surface of upper punch 67 molds second side surface 24 out of the outer peripheral surface of magnetic core 13. First inner die wall 69 of through-hole 62 of die unit 65 molds bottom surface 21. Second inner die wall 70 of through-hole 62 of die unit 65 molds top surface 22. Third inner die wall 71 of through-hole 62 of die unit 65 molds third side surface 25. Fourth inner die wall of through-hole 62 of die unit 65 molds fourth side surface 26.

FIG. 6 and FIG. 7 show lower die 63 and upper die 64 with portions thereof are cut. Boundaries of cut portions are indicated by double-dashed line. A fractured surface is not hatched and a hidden portion is indicated by a broken line. The fourth inner die wall is a cut portion, and thus, is not illustrated.

At least one of first surface 72*a* that is the top surface of lower die 63 and second surface 72*b* that is the bottom surface upper die 64 constitutes a first parting surface. The first parting surface is aligned to first terminal 14 out of first terminal 14 and second terminal 15 disposed on the upper side in the up-down direction, i.e., at a side to second side surface 24. First terminal pocket 90*a* having a groove shape for fitting and accommodating first terminal 14 therein is provided in first surface 72*a* connected with first inner die wall 69 of lower die 63 in a direction perpendicular to through-hole 62. First terminal pocket 90*a* is connected with first inner die wall 69 of lower die and locally recessed. First terminal pocket 90*b* having a groove shape for fitting and accommodating first terminal 14 therein is provided in second surface 72*b* connected with first inner die wall 69 of upper die 64 in a direction perpendicular to through-hole 62. First terminal pocket 90*b* is connected with first inner die wall 69 of upper die 64 and locally recessed.

First terminal pocket 90*a* and first terminal pocket 90*b* allow first terminal 14 to protrude outside cavity 68 when lower die 63 and upper die 64 are closed. First terminal pocket 90*a* and first terminal pocket 90*b* may also be provided in one or both of lower die 63 and upper die 64. FIG. 6 and FIG. 7 show an example of providing the pockets in both lower die 63 and upper die 64.

Upper die fitting projection 74 is unitarily provided on second surface 72*b* that is the bottom surface of upper die 64. Upper die fitting projection 74 is connected with first inner die wall 69 and protrudes downward in a direction of second terminal 15 disposed at a lower part in the up-down direction, i.e., toward second terminal 15 out of first terminal 14 and second terminal 15 which is disposed at a side to first side surface 23.

Lower die fitting recess 75 is provided in first surface 72*a* that is the top surface of lower die 63. Lower die fitting recess 75 is dented locally in a depth aligned to a position of second terminal 15 disposed at a side to first side surface 23 by notching first inner die wall 69, so as to fit with upper die fitting projection 74.

Second terminal pocket 91*a* having a groove shape is provided in the lowest bottom of lower die fitting recess 75 for fitting and accommodating second terminal 15 therein. Second terminal pocket 91*a* is connected with first inner die wall 69 in a direction perpendicular to through-hole 62 and locally recessed. Second terminal pocket 91*b* having a groove shape is provided in the lowest part of upper die fitting projection 74 for fitting and accommodating second terminal 15 therein. Second terminal pocket 91*b* is connected with first inner die wall 69 in a direction perpendicular to through-hole 62, and recessed locally.

Second terminal pocket 91*a* and second terminal pocket 91*b* allow second terminal 15 to protrude outside cavity 68 when lower die 63 and upper die 64 are closed. Second terminal pocket 91*a* and second terminal pocket 91*b* may be provided in one or both of lower die 63 and upper die 64. FIG. 6 and FIG. 7 show an example of providing the pockets in both lower die 63 and upper die 64.

This configuration allows second terminal 15 out of first terminal 14 and second terminal 15 protruding from bottom surface 21 to be disposed at a side to first side surface 23 from the center of bottom surface 21, and allows first terminal 14 out of first terminal 14 and second terminal 15 protruding from bottom surface 21 to be disposed at a side to second side surface 24 from the center of bottom surface 21 in a direction connected between first side surface 23 and second side surface 24 of magnetic core 13 of inductor component 11. This configuration increases the creeping length between first terminal 14 and second terminal 15 to increase electric resistance of the surface, and therefore, improves insulation withstand voltage between first terminal 14 and second terminal 15.

At least one of upper die fitting projection 74 and lower die fitting recess 75 constitutes a parting surface. Regarding the parting surface of upper die fitting projection 74 and lower die fitting recess 75, lower die fitting recess 75 has second parting surface 77*a*, third parting surface 78*a* of lower die 63 connected with second parting surface 77*a* of lower die 63, fourth parting surface 79*a* of lower die 63 connected with third parting surface 78*a* of lower die 63, fifth parting surface (third surface) 80*a* of lower die 63 connected with fourth parting surface 79*a* of lower die 63, and sixth parting surface 81*a* connected with fifth parting surface 80*a* of the lower die. Second parting surface 77*a* of lower die 63 extends downward from first surface 72*a* which is near first terminal pocket 90*a* of first terminal 14 disposed at a side to second side surface 24 to the middle of height of first terminal 14 and second terminal 15 in the up-down direction. Third parting surface 78*a* of lower die 63 extends in a horizontal direction (a direction perpendicular to the first direction and the extending direction of first terminal 14 and second terminal 15). Fourth parting surface 79*a* of lower die 63 extends downward. Fifth parting surface (third surface) 80*a* of lower die 63 extends in the horizontal direction at a position of second terminal 15 disposed at a side to first side surface 23. Sixth parting surface 81*a* of lower die 63 extends toward first surface 72*a* of the top surface of lower die 63. Or, in the parting surface of upper die fitting projection 74 and lower die fitting recess 75, upper die fitting projection 74 includes second to sixth parting surfaces 77*b*, 78*b*, 79*b*, 80*b*, and 81*b* of upper die 64 contacting aforementioned surfaces of lower die fitting recess 75.

Second terminal pocket 91*a* having a groove shape for fitting and accommodating second terminal 15 therein is provided in fifth parting surface (third surface) 80*a* of lower die 63 connected with first inner die wall 69 of lower die 63. Second terminal pocket 91*a* is connected with first inner die wall 69 of lower die 63 in a direction perpendicular to through-hole 62 and recessed locally. Second terminal pocket 91*b* having a groove shape for fitting and accommodating second terminal 15 therein is provided in fifth parting surface 80*b* of upper die 64 connected with first inner die wall 69 of upper die 64. Second terminal pocket 91*b* is connected with first inner die wall 69 of upper die 64 in a direction perpendicular to through-hole 62 and recessed locally.

In first to sixth parting surfaces 72*a*, 77*a*, 78*a*, 79*a*, 80*a*, and 81*a* of lower die 63, second parting surface 77*a* is provided at a position on magnetic core 13 extending from third recess inner side surface 47 of recess 31 of magnetic core 13. Fourth parting surface 79*a* is provided at a position on magnetic core 13 extending from sixth recess inner side surface 50 of recess 31. A clearance between the lower end of second parting surface 77*a* and the upper end of fourth parting surface 79*a*, i.e., a width of third parting surface 78*a* in the horizontal direction, is determined in accordance with width CCW1 of recess 31.

Protrusion 76 with a rectangular cross section linearly extends in the up-down direction from first inner die wall 69 of lower die 63 and upper die 64. When lower die 63 and upper die 64 are clamped, protrusion 76 linearly extends in the up-down direction between first terminal pockets 90*a* and 90*b* and second terminal pockets 91*a* and 91*b* from first inner die wall 69 and forms recess 31 in bottom surface 21 of magnetic core 13.

This configuration provides recess 31 in bottom surface 21 of inductor component 11 between first terminal 14 and second terminal 15 from first side surface 23 to second side surface 24. The creeping length along bottom surface 21 between first terminal 14 and second terminal 15 can thus be long to increase electric resistance on the surface. Accordingly, insulation withstand voltage between first terminal 14 and second terminal 15 of inductor component 11 can be improved.

Protruding height CVH of protrusion 76 of lower die 63 is matched with depth CCD2 of recess 31 of magnetic core 13 from the bottom surface of lower die 63 to the lower end of second terminal pocket 91*a*. Width CVW parallel to first inner die wall 69 is matched with width CCW2 of recess 31 of magnetic core 13. This portion forms first recess inner bottom surface 41, first recess inner side surface 45, and fifth recess inner side surface 49 of magnetic core 13.

Protruding height CVH of protrusion 76 from the lower end of second terminal pocket 91*a* of lower die 63 to third parting surface 78*a* of lower die 63 decreases from depth CCD2 of recess 31 of magnetic core 31 to depth CCD1 as approaching third parting surface 78*a*. Width CVW decreases from width CCW2 of recess 31 of magnetic core 13 to CCW1 as approaching third parting surface 78*a*. This portion forms second recess inner bottom surface 42, second recess inner side surface 46, and sixth recess inner side surface 50 of magnetic core 13.

Protruding height CVH of a protruded portion of protrusion 76 of lower die 63 thus decreases as approaching third parting surface 78*a*, and width CVW of the protruded portion of protrusion 76 of lower die 63 decreases as approaching third parting surface 78*a* between the lower end of second terminal pocket 91*a* of lower die 63 and third parting surface 78*a* of lower die 63.

Protruding height CVH of protrusion 76 of upper die 64 from first inner die wall 69 is matched with depth CCD2 of recess 31 of magnetic core 13 from the top surface of upper die 64 to the upper end of first terminal pocket 90*b*. Width CVW of protrusion 76 parallel to first inner die wall is matched with width CCW2 of recess 31 of magnetic core 13. This portion forms fourth recess inner bottom surface 44, fourth recess inner side surface 48, and eighth recess inner side surface 52.

Protruding height CVH of protrusion 76 from the upper end of first terminal pocket 90*b* of upper die 64 to third parting surface 78*b* decreases from depth CCD2 of recess 31 of magnetic core 13 to depth CCD1 as approaching third parting surface 78*b* of upper die 64. Width CVW decreases from CCW2 of recess 31 of magnetic core 13 to width CCW1 as approaching third parting surface 78*b*. This portion forms third recess inner bottom surface 43, third recess inner side surface 47, and seventh recess inner side surface 51 of magnetic core 13.

Protruding height CVH of the protruded portion of protrusion 76 of upper die 64 thus decreases as approaching third parting surface 78*b* of upper die 64 from the upper end of first terminal pocket 90*b* of upper die 64 to third parting surface 78*b* of upper die 64. Width CVW of the protruded portion of protrusion 76 of upper die 64 decreases as approaching third parting surface 78*b* of the upper die.

Lower punch 66 and upper punch 67 have fitting grooves 82 extending in up-down direction. Protrusion 76 provided on lower die 63 and upper die 64 is fitted and inserted in fitting grooves 82, and are inserted slidably into through-hole 62.

Next, cavity 68 of mold die set 61 is filled with coil 12 and the mixture of magnetic metal powder, such as iron-silicon-chromium, and insulative thermosetting resin binder, such as silicone resin.

The magnetic metal powder and the binder are mixed such that the binder covers particles of the magnetic metal powder. The mixture is granulated, and the granules fill cavity 68.

Figure 8:
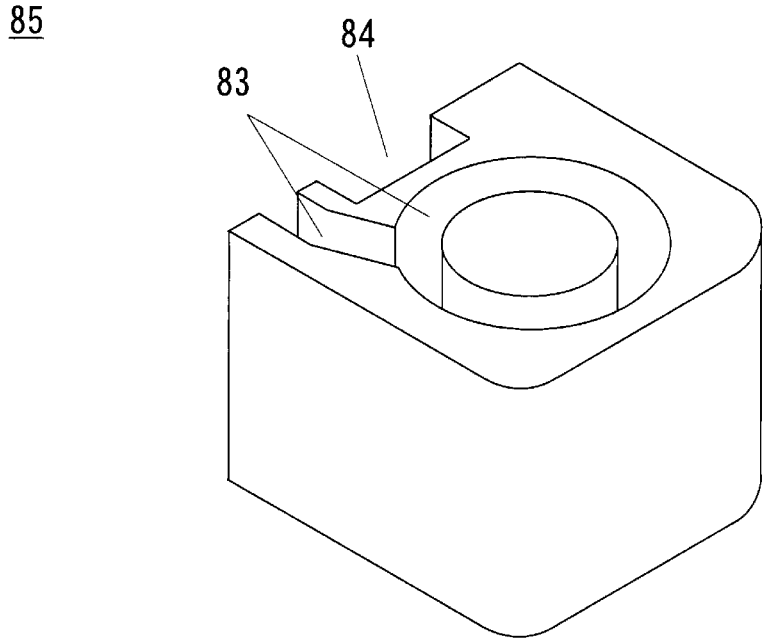
FIG. 8 illustrates a process for manufacturing the inductor component in accordance with the first exemplary embodiment of the present disclosure.

The granules may fill cavity 68 as they are. However, as shown in FIG. 8, the granules may be pressed with a pressure of about 1 ton/cm$^2$ to produce square-pillar powder compact 85. Housing recess 83 for housing therein coil 12, first terminal, and second terminal 15 is provided inside powder compact 85 with fitting groove 84 for inserting protrusion 76 is provided outside. Powder compact 85 may fill cavity 58 such that two powder compacts 85 cover coil 12 from the top and bottom. This configuration preferable fills cavity 68 with the granules efficiently.

Figure 9:
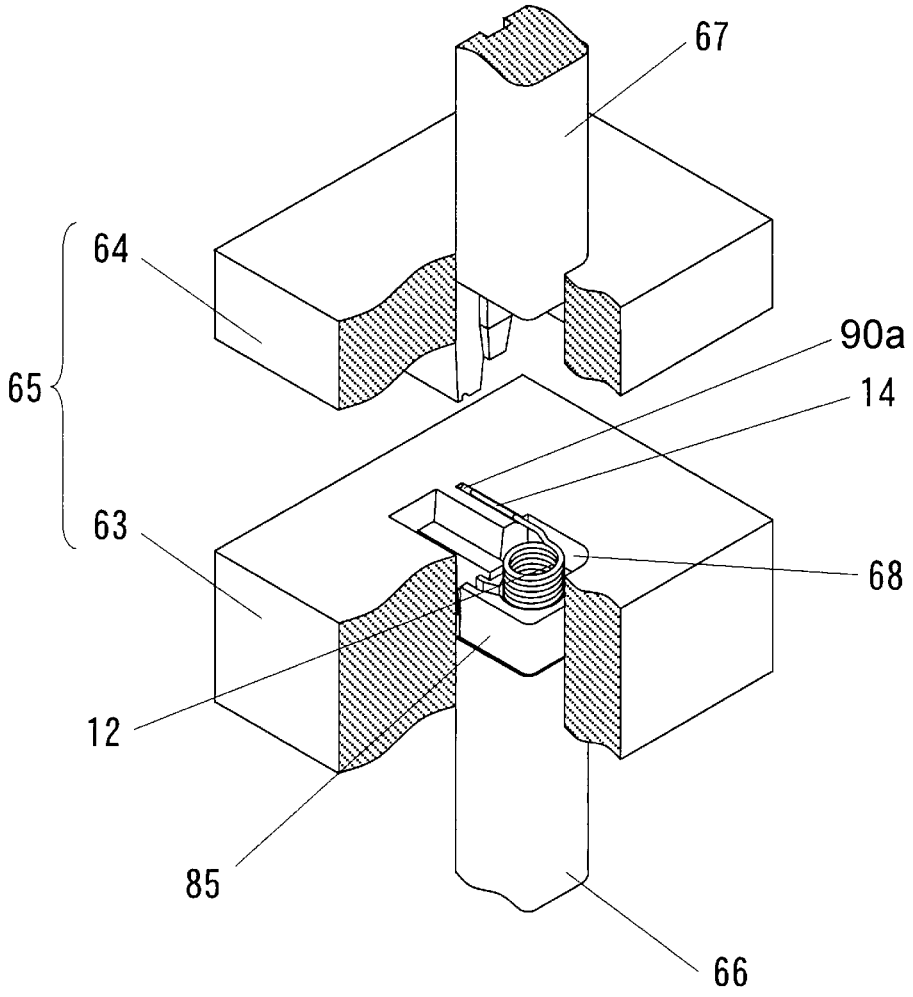
FIG. 9 illustrates a process for manufacturing the inductor component in accordance with the first exemplary embodiment of the present disclosure.

Coil 12 and powder compact 85 fill cavity 68 by inserting lower punch 66 into through-hole 62 in lower die 63 up to a predetermined position, as shown in FIG. 9. Then, first powder compact 85 with housing recess 83 (FIG. 8) facing up is placed in cavity 68. Next, a bottom half of coil 12 with the winding axis direction in the up-down direction is placed in housing recess 83, and first terminal 14 and second terminal 15 (FIG. 5) are fitted into first terminal pocket 90*a* and second terminal pocket 91*a* of lower die 63.

In FIGS. 9 and 10 to 13 in the subsequent description, lower die 63 and upper die 64 are partially cut and hatching is provided on cut sections. Portions hidden behind cut sections are not illustrated.

Figure 10:
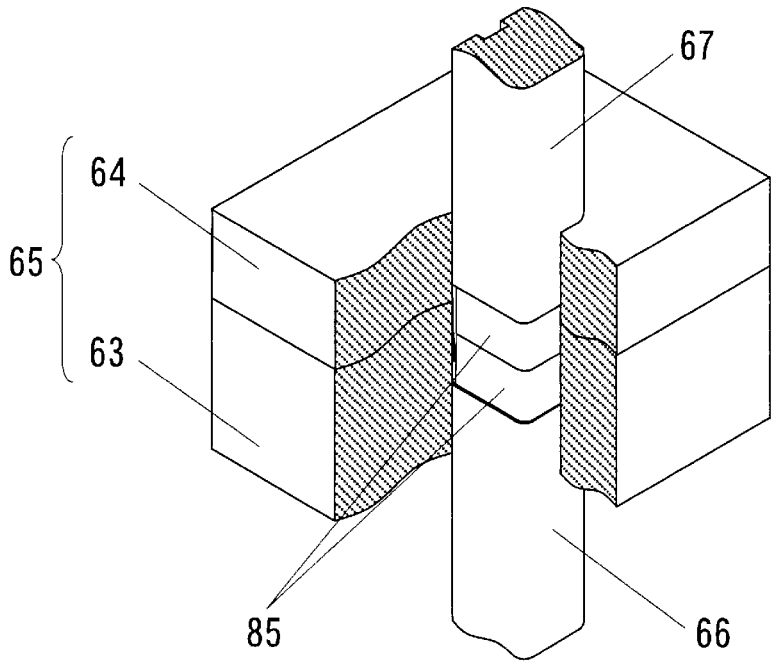
FIG. 10 illustrates a process for manufacturing the inductor component in accordance with the first exemplary embodiment of the present disclosure.

As shown in FIG. 10, second powder compact 85 with housing recess 83 facing downward (FIG. 8) is placed to cover a top half of coil 12 (FIG. 5). Upper die 64 is lowered to close die unit 65, and upper punch 67 is lowered to a predetermined position to fill cavity 68 (FIG. 9) with coil 12 and two powder compacts 85.

Figure 11:
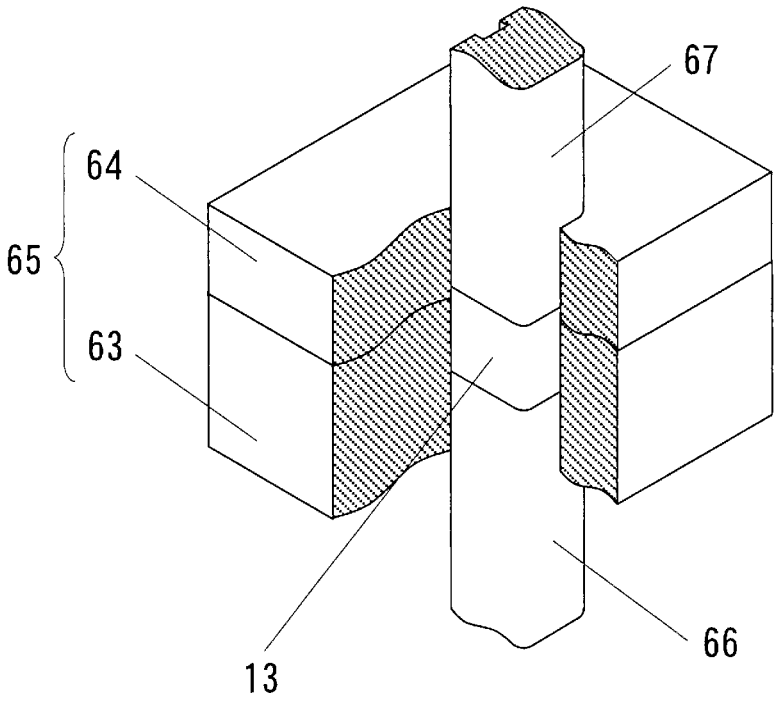
FIG. 11 illustrates a process for manufacturing the inductor component in accordance with the first exemplary embodiment of the present disclosure.

Next, as shown in FIG. 11, a pressure of about 5 ton/cm$^2$ is vertically applied to lower punch 66 and upper punch 67. Powder compacts 85 then collapses so that the mixture of magnetic metal powder and binder densely fills the hollow at the winding core and covers the outer periphery of coil 12 to pressure-mold magnetic core 13.

Next, molded magnetic core 13 is taken out from mold die set 61.

Figure 12:
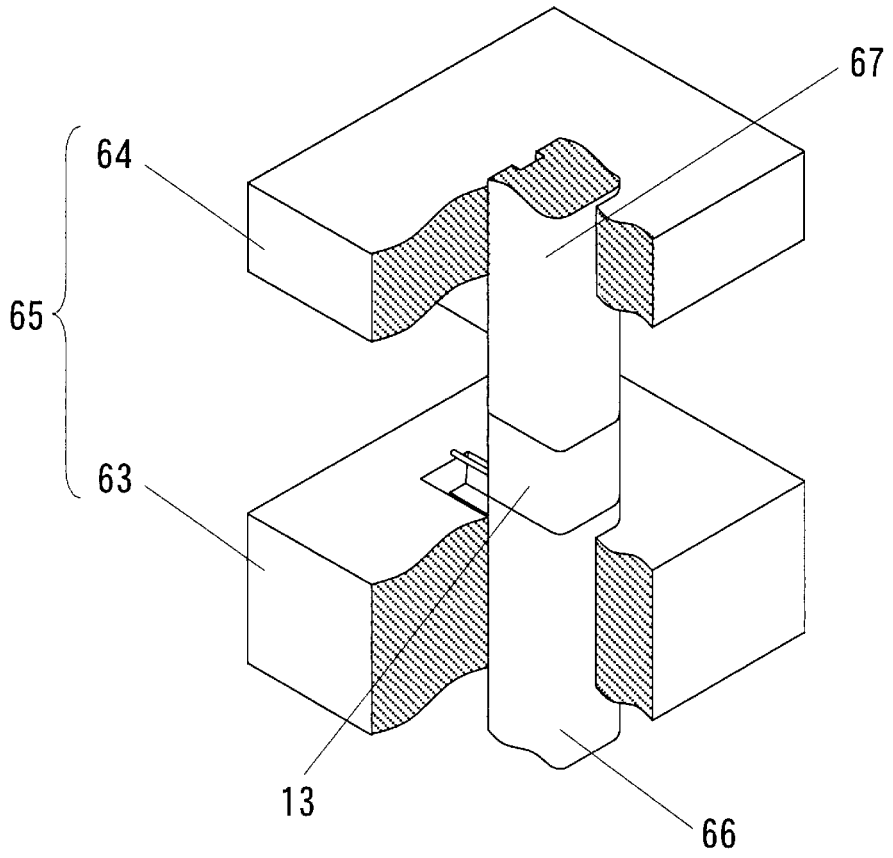
FIG. 12 illustrates a process for manufacturing the inductor component in accordance with the first exemplary embodiment of the present disclosure.

First, as shown in FIG. 12, while a pressure of about several hundreds of kg/cm$^2$ is applied to molded magnetic core 13 with lower punch 66 and upper punch 67, lower die 63 is lowered and upper die 64 rises to open die unit 65.

In accordance with the exemplary embodiment, protruding height CVH and width CVW of the protruded portion of protrusion 76 of lower die 63 decreases as approaching third parting surface 78*a* from the lower end of second terminal pocket 91*a* of lower die 63 of mold die set 61 to third parting surface 78*a* of lower die 63. Protruding height CVH and width CVW of the protruded portion of protrusion 76 of upper die decrease as approaching third parting surface 78*b* from the upper end of first terminal pocket 90*b* of upper die 64 to third parting surface 78*b* of upper die 64. This configuration avoids rubbing of the inner surface of recess 31 of magnetic core 13 between first terminal 14 and second terminal 15 against lower die 63 and upper die 64. This prevents damage on the binder-coated particles of magnetic metal powder to form an area on the inner surface of recess 31 that has electric resistance higher than the surface of bottom surface 21, except for recess 31. This configuration improves insulation withstand voltage between first terminal 14 and second terminal 15 of inductor component 11.

Figure 13:
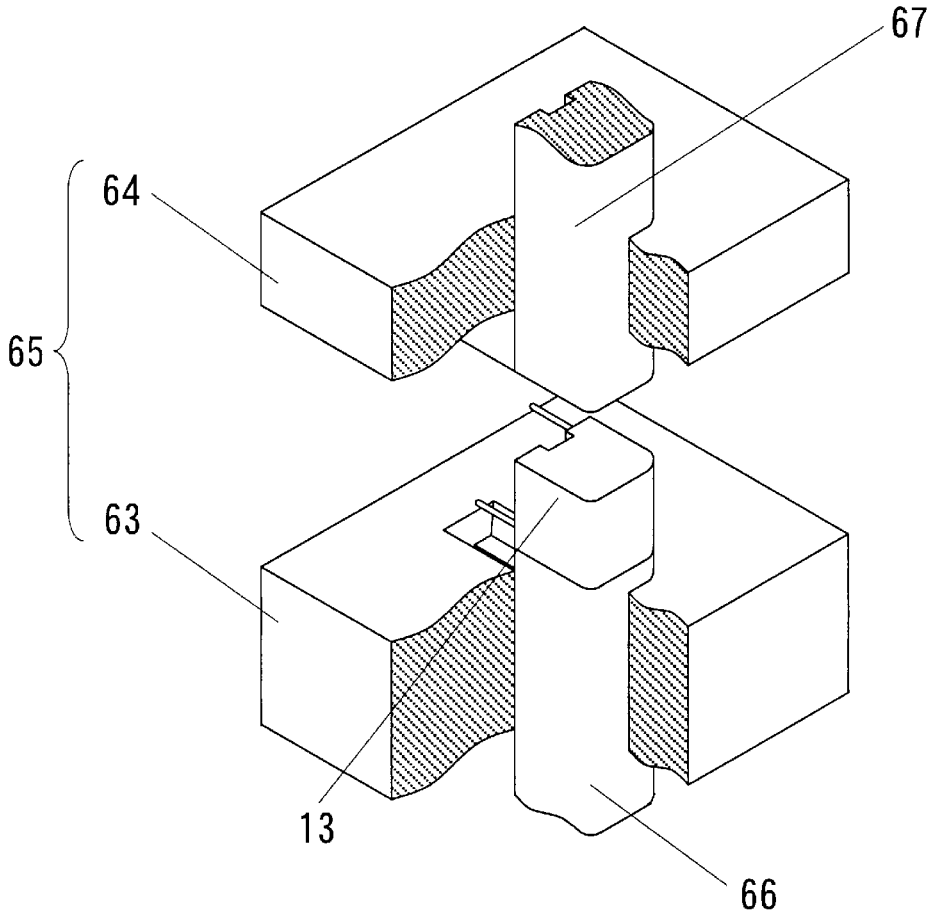
FIG. 13 illustrates a process for manufacturing the inductor component in accordance with the first exemplary embodiment of the present disclosure.

Then, as shown in FIG. 13, upper punch 67 is raised to take out molded magnetic core 13.

Finally, molded magnetic core 13 is thermally treated to thermoset silicone resin of the binder, and first terminal 14 and second terminal 15 are soldered as required to complete inductor component 11 shown in FIG. 1.

Second Exemplary Embodiment

An inductor component in accordance with a second exemplary embodiment of the present disclosure will be described below with reference to drawings.

Figure 14:
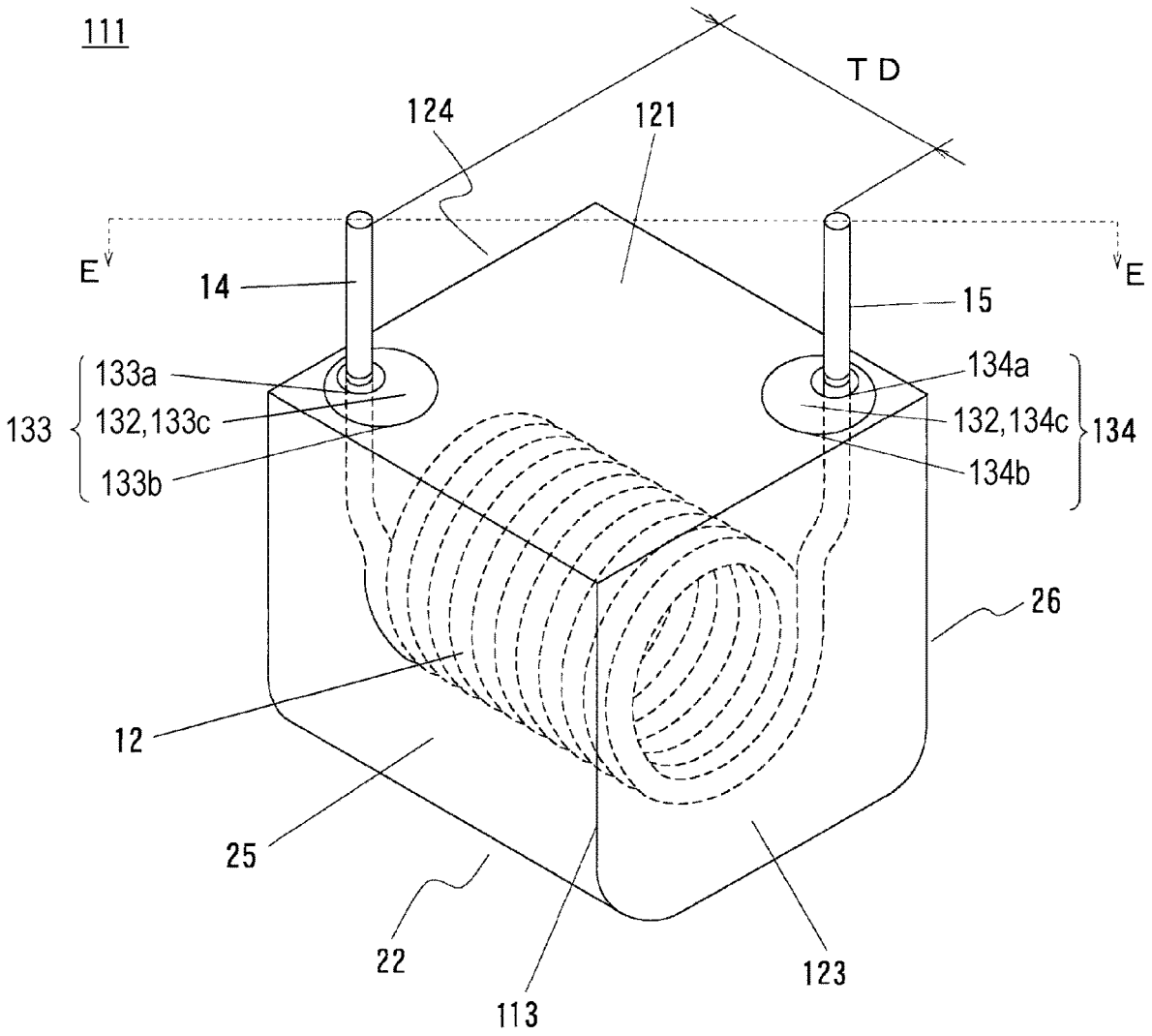
FIG. 14 is a perspective view of an inductor component in accordance with a second exemplary embodiment of the present disclosure seen from a bottom surface of the inductor component.
Figure 15:
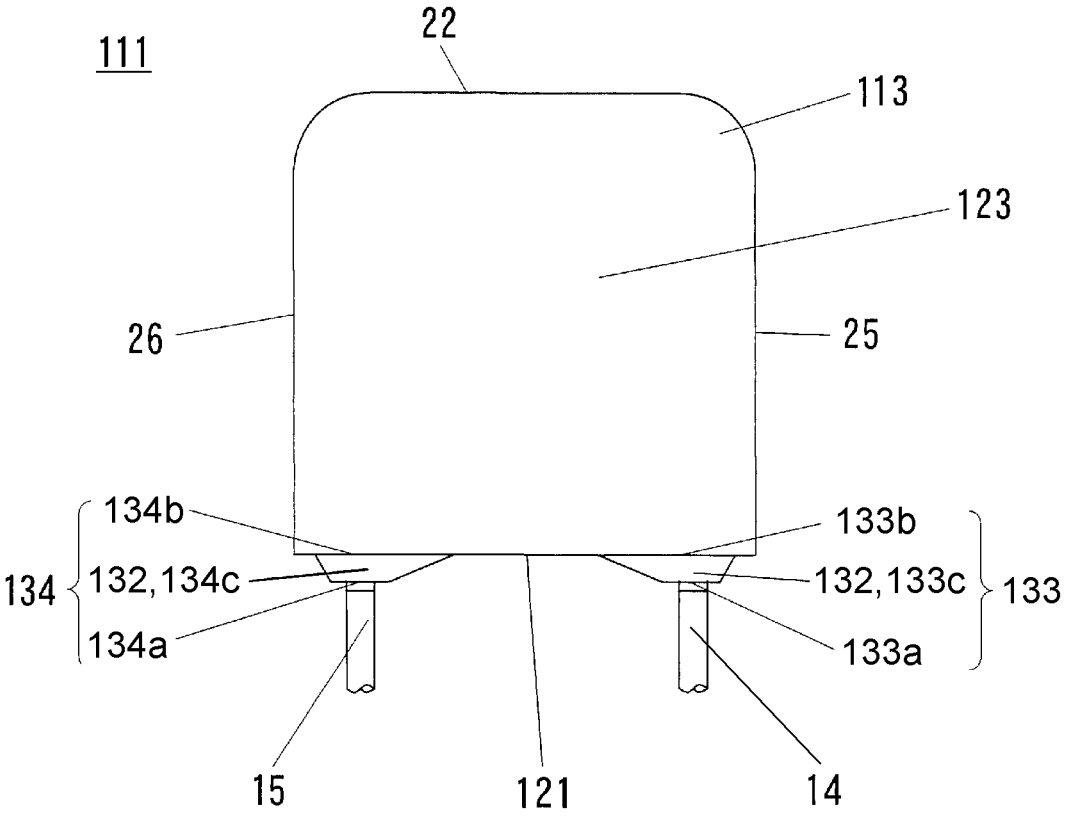
FIG. 15 is a plan view of the inductor component in accordance with the second exemplary embodiment of the present disclosure seen from a first side surface of the inductor component.
Figure 16:
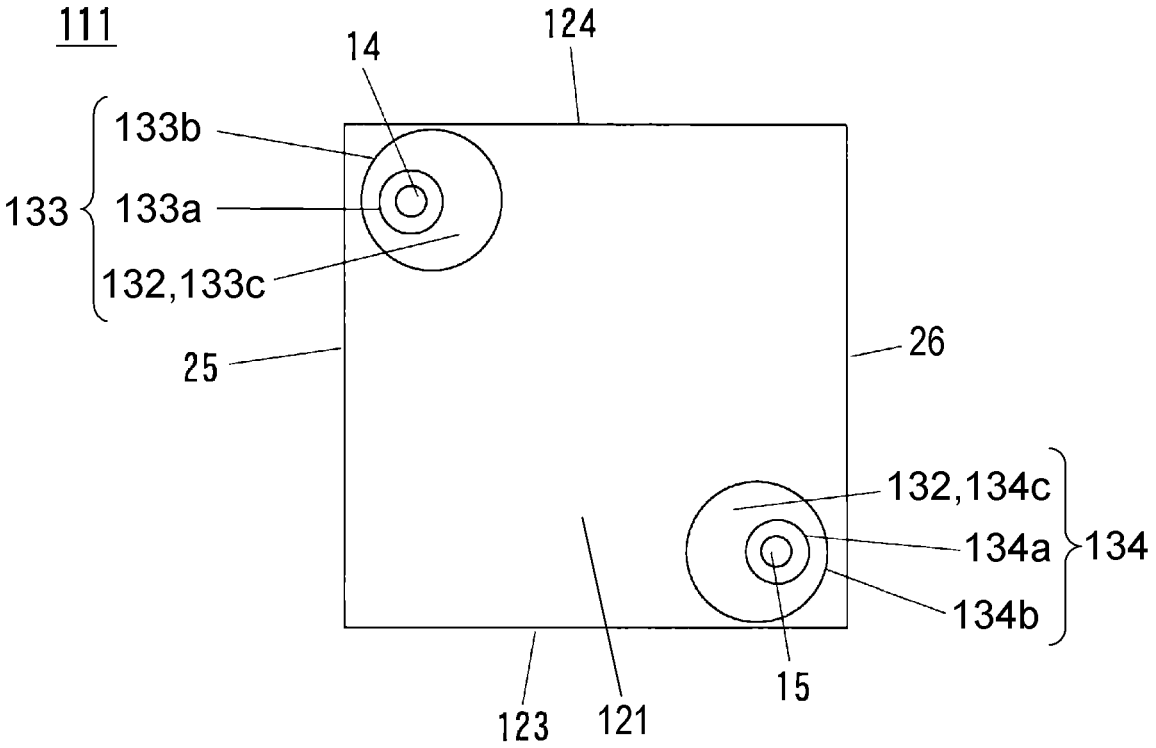
FIG. 16 is a plan view of the inductor component in accordance with the second exemplary embodiment seen from the bottom surface of the inductor component.

FIG. 14 is a perspective view of an inductor component in accordance with the second exemplary embodiment of the present disclosure seen from a bottom surface of the inductor component. FIG. 15 is a plan view of the inductor component seen from first side surface 123. FIG. 16 is a plan view of the inductor component seen from the bottom surface.

As shown in FIGS. 14 to 16, inductor component 111 in accordance with the second exemplary embodiment of the present disclosure includes coil 12, magnetic core 113, and first terminal 14 and second terminal that are through-hole mounting terminals. Coil 12 includes a wound conductive wire embedded in magnetic core 113. First terminal 14 and second terminal 15 are conductive wires extending from both ends of coil 12 in the same direction and protruding from the same surface of magnetic core 113 in the same direction to be inserted into through-holes of a mounting board (not illustrated) and connected to an electric circuit.

Coil 12, first terminal 14, and second terminal 15 are identical to those of the inductor component in accordance with the first exemplary embodiment, and thus their detailed description of is omitted.

In inductor component 111 in accordance with the second exemplary embodiment of the present disclosure, magnetic core 113 includes first terminal-covering part 133 and second terminal-covering part 134 that cover base parts of first terminal 14 and second terminal 15, respectively. First terminal-covering part 133 and second terminal-covering part 134 are uplifted from bottom surface 121 at bases of first terminal 14 and second terminal 15 in the extending direction of first terminal 14 and second terminal 15. Magnetic core 113 is identical to magnetic core 13 in accordance with the first exemplary embodiment, except for first terminal-covering part 133 and second terminal-covering part 134, and thus its detailed description is omitted here.

First terminal-covering part 133 will be described. First terminal-covering part 133 includes tip portion 133*a* of the first terminal-covering part, bottom surface 133*b* of the first terminal-covering part, and side surface 133*c* of the first terminal-covering part 133. Tip portion 133*a* of the first terminal-covering part is uplifted at the tip end. Bottom surface 133*b* of the first terminal-covering part is a portion connected with bottom surface 121. Side surface 133*c* of the first terminal-covering part constituting a side surface of first terminal-covering part 133 is connected with tip portion 133*a* of the first terminal-covering part at the tip and a portion of bottom surface 133*b* of the first terminal-covering part connected with bottom surface 121. Second terminal-covering part 134 has the same structure as first terminal-covering part 133.

Figure 17:
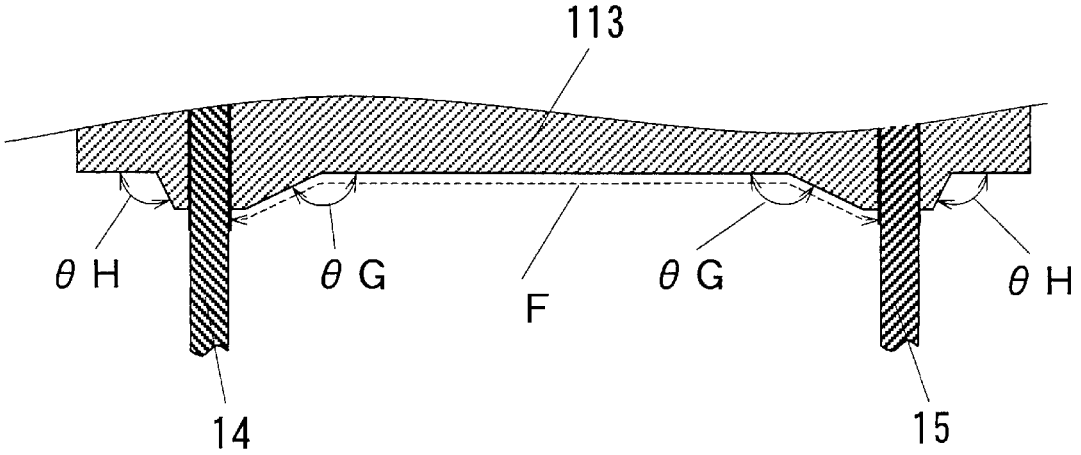
FIG. 17 is a sectional view taken along Line E-E in FIG. 14.

FIG. 17 is a sectional view of the inductor component along line E-E shown in FIG. 14. First terminal 14, second terminal 15, and magnetic core 113 are illustrated in a cross section along straight line E-E passing between first terminal 14 and second terminal 15. A creeping length between first terminal 14 and second terminal 15 is indicated by dotted line F.

In the conventional inductor component, the creeping length between terminals 4 (FIG. 26) is a length of a straight line between positions at which first terminal 14 and second terminal 15 protrude. In contrast, in accordance with the second exemplary embodiment, first terminal-covering part 133 and second terminal-covering part 134 uplifted from bottom surface 121 are provided to cover the base parts of first terminal 14 and second terminal 15, respectively. Therefore, the creeping length along bottom surface 121 between first terminal 14 and second terminal 15 passes side surface 133*c* of the first terminal-covering part and side surface 134*c* of the second terminal-covering part uplifted from bottom surface 121. The creeping length along bottom surface 121 between first terminal 14 and second terminal 15 can be longer to increase electric resistance on the surface between first terminal 14 and second terminal 15. This configuration can improve insulation withstand voltage between first terminal 14 and second terminal 15.

First terminal-covering part 133 and second terminal-covering part 134 may provide part of the binder coating particles of magnetic metal powder with damages on the surface of bottom surface 121 by being rubbed against the lower die and the upper die at opening the lower die and the upper die of the die unit and taking out molded magnetic core 113 from the die unit of the mold for molding magnetic core 113. On the other hand, side surface 133*c* of the first terminal-covering part and side surface 134*c* of the second terminal-covering part are released without being rubbed against the lower die and the upper die to eliminate any damage to the binder coating particles of magnetic metal powder. Accordingly, high resistance area 132 with electric resistance higher than that on the surface of bottom surface 121 can be provided on surfaces of side surface 133*c* of the first terminal-covering part and side surface 134*c* of the second terminal-covering part.

Since the creeping length between first terminal 14 and second terminal 15 passes high resistance area 132, insulation withstand voltage between first terminal 14 and second terminal 15 can be increased.

In this case, in particular, areas of tip portion 133*a* of the first terminal-covering part and tip portion 134*a* of the second terminal-covering part in the extending direction of first terminal 14 and second terminal 15 are set to be smaller than areas of bottom surface 133*b* of the first terminal-covering part and bottom surface 134*b* of the second terminal-covering part in first terminal-covering part 133 and second terminal-covering part 134. Side surface 133*c* of the first terminal-covering part and side surface 134*c* of the second terminal-covering part connected with tip portion 133*a* of the first terminal-covering part and tip portion 134*a* of the second terminal-covering part and connected with bottom surface 133*b* of the first terminal-covering part and bottom surface 134*b* of the second terminal-covering part preferably incline to provide truncated cone shapes of the terminal-covering parts.

Inclining side surface 133*c* of the first terminal-covering part and inclining side surface 134*c* of the second terminal-covering part can provide side surface 133*c* of the first terminal-covering part and side surface 134*c* of the second terminal-covering part with long dimensions and high electric resistance on their surfaces. This configuration increases insulation withstand voltage between first terminal 14 and second terminal 15.

At least one of first terminal-covering part 133 and second terminal-covering part 134 may be provided.

In the cross section of the inductor component along a straight line passing first terminal 14 and second terminal 15 shown in FIG. 17, bottom surface 121 and each of side surface 133*c* of the first terminal-covering part form angle θG in an area between first terminal 14 and second terminal 15. Bottom surface 121 and each of side surface 133*c* of the first terminal-covering part and bottom surface 121 and side surface 134*c* of the second terminal-covering part form angle θH outside the area between first terminal 14 and second terminal 15. Angle θG is preferably larger than angle θH, This configuration decreases areas at an outer side of first terminal-covering part 133 and second terminal-covering part 134 on bottom surface 121 between first terminal 14 and second terminal 15, and accordingly, increases insulation withstand voltage between first terminal 14 and second terminal 15 and reduces the size of inductor component 111.

In this case, angle θG formed by bottom surface 121 and each of side surface 133*c* of the first terminal-covering part and side surface 134*c* of the second terminal-covering part in the area between first terminal 14 and second terminal 15 may range preferably from 120 degrees to 160 degrees. Angle θG smaller than 120 degrees unpreferably reduces an effect of increasing electric resistance on the surface. Angle θG larger than 160 degrees unpreferably increases the size of inductor component 111. Angle θG may range more preferably from 135 degrees to 150 degrees.

Angle θH formed by bottom surface 121 and each of side surface 133*c* of the first terminal-covering part and side surface 134*c* of the second terminal-covering part and bottom surface 121 at an outer side of the area between first terminal 14 and second terminal 15 may preferably range from 90 degrees to 120 degrees. Angle θH smaller than 90 degrees unpreferably causes the mold for molding magnetic core 113 to be complicated, and degrades productivity accordingly. Angle θH larger than 120 degrees unpreferably increases the size of inductor component 111. Angle θH may range more preferably from 90 degrees to 105 degrees.

In first terminal-covering part 133 and second terminal-covering part 134 with the truncated cone shapes, tip portion 133*a* of the first terminal-covering part and tip portion 134*a* of the second terminal-covering part are inner areas at the tips of side surface 133*c* of the first terminal-covering part and side surface 134*c* of the second terminal-covering part. As shown in FIGS. 14 to 17, tip portion 133*a* contacting the first terminal-covering part and tip portion 134*a* contacting the second terminal-covering part in cross sections of first terminal 14 and second terminal 15 may have flat portions. Conversely, side surface 133*c* of the first terminal-covering part and side surface 134*c* of the second terminal-covering part may contact first terminal 14 and second terminal 15, respectively. In the case that no flat portion is provided at tip portion 133*a* of the first terminal-covering part and tip portion 134*a* of the second terminal-covering part, first terminal 14 and second terminal 15 contacts the first terminal-covering part and the second terminal-covering part at tip portion 133*a* and tip portion 134*a*, respectively.

In the case that first terminal-covering part 133 and second terminal-covering part 134 have truncated cone shapes and no flat portion is provided on tip portion 133*a* of the first terminal-covering part and tip portion 134*a* of the second terminal-covering part, as described above, an angle formed by side surface 133*c* of the first terminal-covering part and first terminal 14 and an angle formed by side surface 134*c* of the second terminal-covering part and second terminal 15 in the mold die set become larger than 90 degrees. This configuration prevents the mold die set from contacting the insulation film of the conductive wire at the base parts of first terminal 14 and second terminal 15. Thus, damage to the insulation film can be suppressed.

As shown in FIG. 14, second terminal 15 out of first terminal 14 and second terminal 15 protruding from bottom surface 121 is preferably closer to first side surface 123 than to the center of bottom surface 121 in a direction connected between first side surface 123 and second side surface 124. First terminal 14 out of first terminal 14 and second terminal 15 protruding from bottom surface 121 is preferably closer to second side surface 124 than to the center of bottom surface 121 in the direction connected between first side surface 123 and second side surface 124. Length TD is preferably provided between first terminal 14 and second terminal 15 such that first terminal 14 and second terminal 15 are located closer to first side surface 123 and second side surface 124 than to the center of bottom surface 121, respectively.

This configuration increases the creeping length between first terminal 14 and second terminal 15 and increases electric resistance of the surface accordingly. This improves insulation withstand voltage between first terminal 14 and second terminal 15.

In this case, first terminal 14 and second terminal 15 are preferably separated symmetrically to each other with respect to the center of bottom surface 121. Second terminal 15 is preferably disposed in a corner area formed by first side surface 123 and fourth side surface 26 while first terminal 14 is preferably disposed in a corner area formed by second side surface 124 and third side surface 25.

This configuration increases the creeping length between first terminal 14 and second terminal 15, and improves insulation withstand voltage between first terminal 14 and second terminal 15. In addition, first terminal 14 and second terminal 15 disposed symmetrically to each other with respect to the center of bottom surface 121 can balance a load applied to first terminal 14 and second terminal 15 when the inductor component is through-hole mounted on a mounting board.

The second exemplary embodiment shown in FIGS. 14 to 17 provides an example of first terminal-covering part 133 and second terminal-covering part 134 with the truncated cone shapes. First terminal-covering part 133 and second terminal-covering part 134 may have truncated pyramid shapes.

The conductive wires constituting coil 12, first terminal 14, and second terminal 15 has a circular cross section in the description, but the conductive wire may have a rectangular cross section, providing the same effect as the second exemplary embodiment.

A method for manufacturing inductor component 111 in accordance with the second exemplary embodiment of the present disclosure will be described below with reference to FIGS. 5 and 18 to 25.

First, coil 12 is formed by winding a conductive wire, as shown in FIG. 5.

Coil 12 is formed by winding the conductive wire, such as copper, with insulation coating of enamel or polyamide-imide around a predetermined winding shaft.

After winding the conductive wire, coil 12 is removed from the winding shaft to form a hollow winding core in coil 12.

A conductive wire with welded layer having a welded layer on an outer periphery of the insulation film may be used to retain the shape of coil 12.

Next, first terminal 14 and second terminal 15 extending from both ends of coil 12 in the same direction are formed.

First terminal 14 and second terminal 15 are formed by extending both ends of coil 12 in the same direction perpendicular to a direction of the winding axis of the conductive wire, and by removing the insulation film of the conductive wire for a predetermined length required for through-hole mounting of inductor component 111.

Next, magnetic metal powder and insulation resin binder are mixed to prepare a mixture thereof. Coil 12 is embedded in the mixture. Then, the mixture is pressure-molded to form magnetic core 113 having bottom surface 121, top surface 22 opposite to bottom surface 121, first side surface 123 perpendicular to bottom surface 121 on one end of the winding axis direction of coil 12 and connected with bottom surface 121 and top surface 22, second side surface 124 opposite to first side surface 123 on the other end of the winding axis direction of coil 12, third side surface 25 connected with first side surface 123 and second side surface 124, and fourth side surface 26 opposite to third side surface 25.

Figure 18:
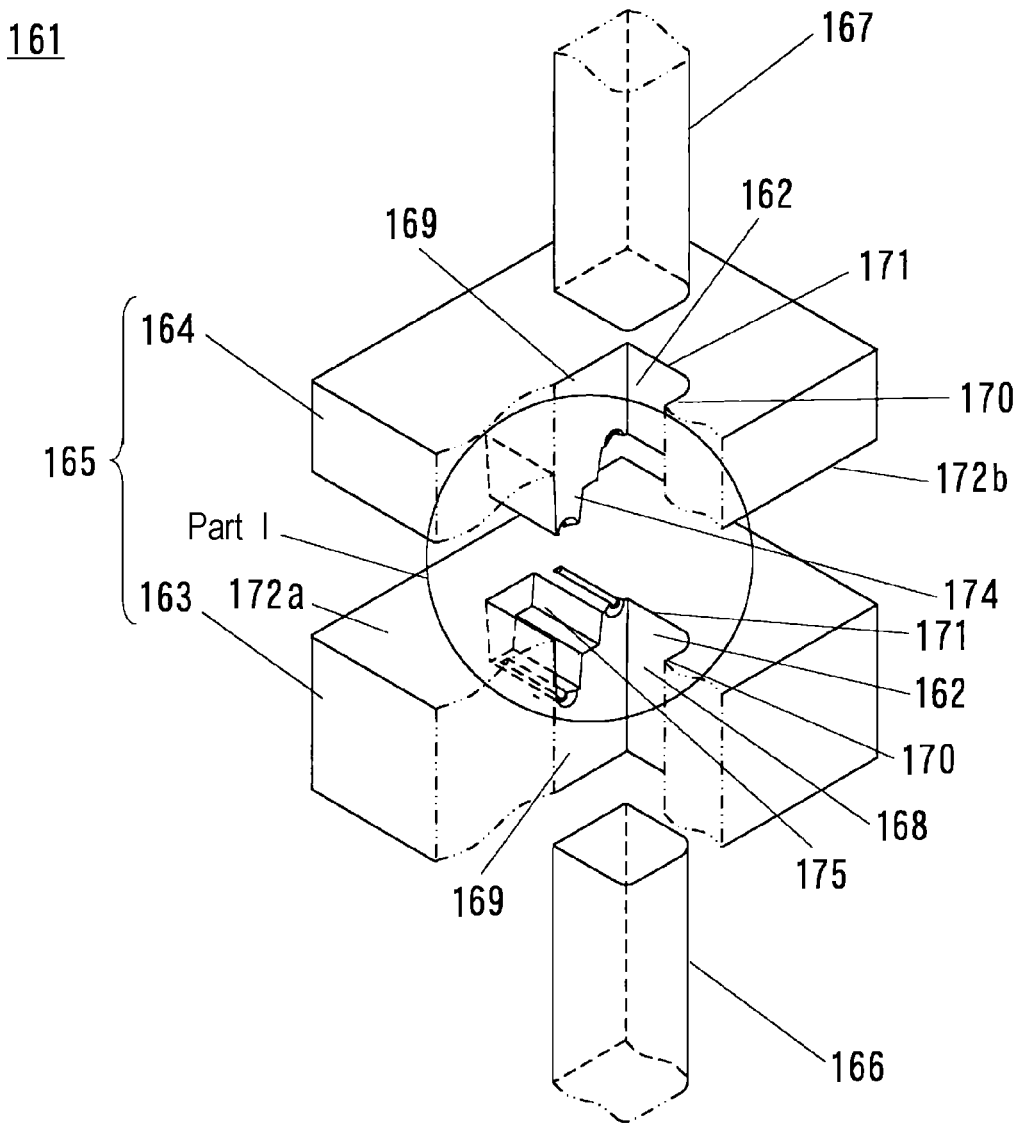
FIG. 18 illustrates a process for manufacturing the inductor component in accordance with the second exemplary embodiment of the present disclosure.
Figure 19:
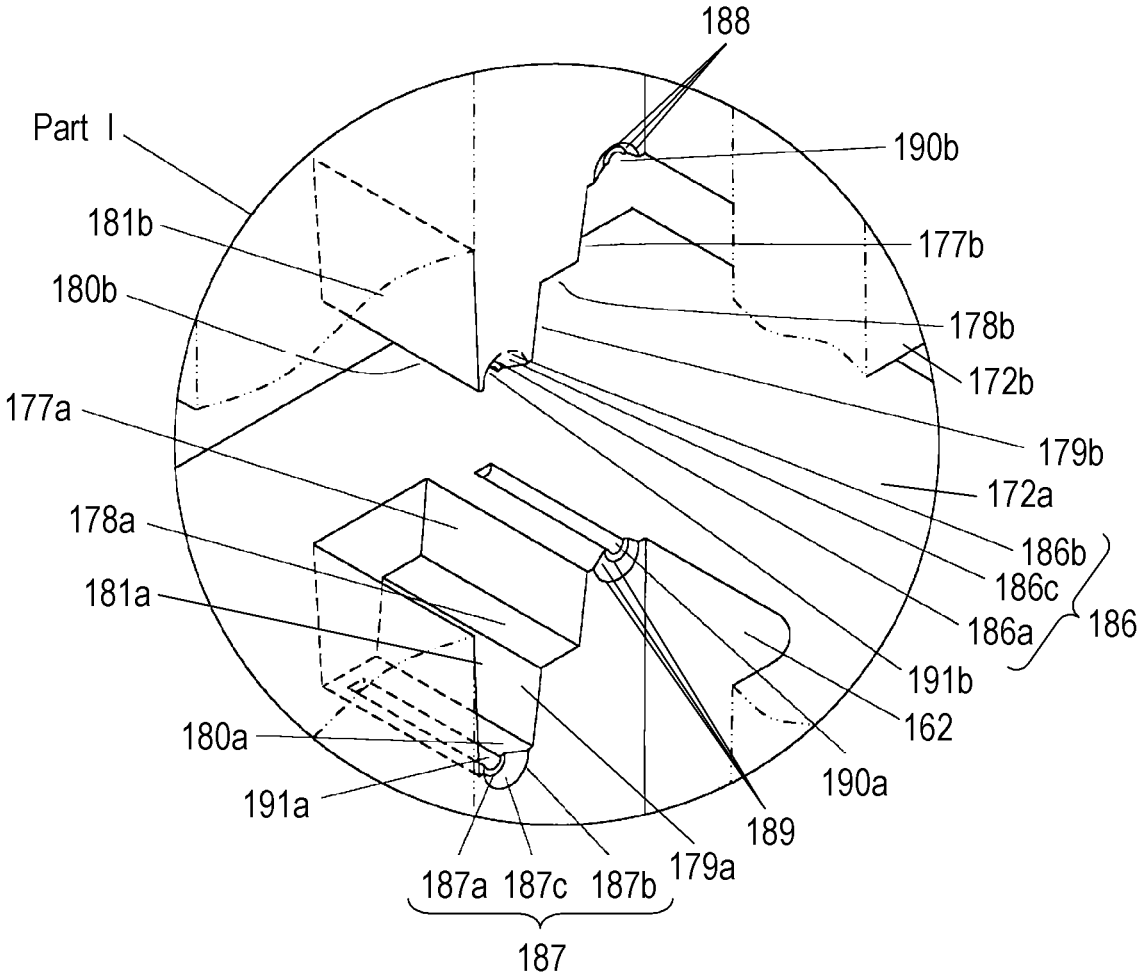
FIG. 19 is an enlarged view of Part I of the inductor component shown in FIG. 18.

Mold die set 161 for pressure-molding magnetic core 113 shown in FIG. 18 and FIG. 19 is prepared. FIG. 19 is an enlarged view of Part D of the mold die set in FIG. 18.

Mold die set 161 has through-hole 162 extending in an up-down direction (hereinafter, an upward direction is the first direction), and includes die unit 165, lower punch (first punch) 166 provided below die unit 165, and upper punch (second punch) 167 disposed above die unit 165. Die unit 165 can be vertically separated into lower die (first die) 163 and upper die 164 (second die). Lower punch 166 is inserted into through-hole 162 slidably and vertically. Upper punch 167 is inserted into through-hole 162 slidably and vertically.

Cavity 168, a space surrounded by through-hole 162, lower punch 166, and upper punch 167 is formed in die unit 165. Cavity 168 forms the shape of magnetic core 113 to mold magnetic core 113.

Magnetic core 113 is pressure-molded by pressing the mixture such that lower punch 166 and upper punch 167 approach each other in the up-down direction. A top surface of lower punch 166 molds first side surface 123 out of the outer peripheral surface of magnetic core 113. A bottom surface of upper punch 167 molds second side surface 124 out of the outer peripheral surface of magnetic core 113. First inner die wall 169 of through-hole 162 of die unit 165 molds bottom surface 121 out of the outer peripheral surface of magnetic core 113. Second inner die wall 170 of through-hole 162 of die unit 165 molds top surface 22 out of the outer peripheral surface of magnetic core 113. Third inner die wall 171 of through-hole 162 of die unit 165 molds third side surface 25 out of the outer peripheral surface of magnetic core 113. Fourth inner die wall of through-hole 162 of die unit 165 molds fourth side surface 26 out of the outer peripheral surface of magnetic core 113.

Here, in FIG. 18 and FIG. 19, some of lower die 163 and upper die 164 are cut, and boundaries of cut portions are indicated with double-dashed line. A fractured surface is not hatched and a hidden portion is indicated by a broken line. The fourth inner die wall is a cut portion and thus not illustrated.

At least one of first surface 172*a* that is the top surface of lower die 163 and second surface 172*b* that is the bottom surface of upper die 164 constitute a first parting surface. The first parting surface is aligned to first terminal 14 disposed on the upper side in the vertical direction, i.e., the side of second side surface 124, in first terminal 14 and second terminal 15. First terminal pocket 190*a* having a groove shape for fitting and accommodating first terminal 14 is provided in first surface 172*a* connected with first inner die wall 169 of lower die 163 in a direction perpendicular to through-hole 162. First terminal pocket 190*a* is connected with first inner die wall 169 and recessed locally. First terminal pocket 190*b* having a groove shape for fitting and housing first terminal 14 is provided in second surface 172*b* connected with first inner die wall 169 of upper die 164 in a direction perpendicular to through-hole 162. First terminal pocket 190*b* is connected with first inner die wall 169 of upper die 164 and recessed locally.

First terminal pocket 190*a* and first terminal pocket 190*b* allow first terminal 14 to protrude outside cavity 168 when lower die 163 and upper die 164 are closed. First terminal pocket 190*a* and first terminal pocket 190*b* may also be provided on one or both of lower die 163 and upper die 164. FIG. 18 and FIG. 19 provide an example of providing the pockets in both lower die 163 and upper die 164.

Upper die fitting projection 174 is formed unitarily with second surface 172*b* that is the bottom surface of upper die 164. Upper die fitting projection 174 is connected with first inner die wall 169 and protrudes downward in a direction of second terminal 15 out of first terminal 14 and second terminal 15 disposed at a lower part in the up-down direction, i.e., toward second terminal 15 disposed at a side to first side surface 123.

Lower die fitting recess 175 is provided in first surface 172*a* that is the top surface of lower die 163. Lower die fitting recess 175 is dented locally by a depth aligned to a position of second terminal 15 disposed at a side to first side surface 123 by notching first inner die wall 169, so as to fit with upper die fitting projection 174.

Second terminal pocket 191*a* having a groove shape is provided in the lowest bottom of lower die fitting recess 175 for fitting and accommodating second terminal 15 therein. Second terminal pocket 191*a* is connected with first inner die wall 169 in a direction perpendicular to through-hole 162 and is recessed locally. Second terminal pocket 191*b* having a groove shape is provided in the lowest part of upper die fitting projection 174 for fitting and accommodating second terminal 15 therein. Second terminal pocket 191*b* is connected with first inner die wall 169 in a direction perpendicular to through-hole 162, and recessed locally.

Second terminal pocket 191*a* and second terminal pocket 191*b* make second terminal 15 allow outside cavity 168 to protrude when lower die 163 and upper die 164 are closed. Second terminal pocket 191*a* and second terminal pocket 191*b* may be provided in one or both of lower die 163 and upper die 164. FIG. 18 and FIG. 19 provide an example of providing the pockets in both lower die 163 and upper die 164.

At least upper die fitting projection 174 and lower die fitting recess 175 constitutes a parting surface. Regarding the parting surface of upper die fitting projection 174 and lower die fitting recess 175, lower die fitting recess 175 has second parting surface 177*a* of lower die 163. Second parting surface 177*a* extends downward from first surface 172*a* near first terminal pocket 190*a* of first terminal 14 disposed at a side of second side surface 124 to the middle of height of first terminal 14 and second terminal 15 in the up-down direction. Lower die 163 has third parting surface 178*a*, fourth parting surface 179*a*, fifth parting surface 180*a*, and sixth parting surface 181*a* of lower die 163. Third parting surface 178*a* is connected with second parting surface 177*a* of lower die 163 and extends in a horizontal direction (a direction perpendicular to the first direction and the extending direction of first terminal 14 and second terminal 15). Fourth parting surface 179*a* of lower die 163 is connected with third parting surface 178*a* of lower die 163 and extends downward. Fifth parting surface 180*a* of lower die 163 is connected with fourth parting surface 179*a* of lower die 163 and extends in the horizontal direction at a position of second terminal 15 disposed at a side of first side surface 123. Sixth parting surface 181*a* of lower die 163 is connected with fifth parting surface 180*a* of lower die 163 and toward first surface 172*a* that is the top surface of lower die 163. Or, in the parting surface of upper die fitting projection 174 and lower die fitting recess 175, upper die fitting projection 174 includes second to sixth parting surfaces 177*b*, 178*b*, 179*b*, 180*b*, and 181*b* of upper die 164 contacting the above-described surfaces of lower die fitting recess 175.

Second terminal pocket 191*a* having a groove shape for fitting and accommodating second terminal 15 therein is provided in fifth parting surface (third surface) 180*a* of lower die 163 connected with first inner die wall 169 of lower die 163. Second terminal pocket 191*a* is connected with first inner die wall 169 of lower die 163 in a direction perpendicular to through-hole 162 and recessed locally. Second terminal pocket 191*b* having a groove shape is provided in fifth parting surface (fourth surface) 180*b* of upper die adjoining first inner die wall 169 of upper die 164 for fitting and accommodating second terminal 15 therein. Second terminal pocket 191*b* is connected with first inner die wall 169 of upper die 64 in a direction perpendicular to through-hole 162 and recessed locally.

This configuration allows second terminal 15 out of first terminal 14 and second terminal 15 protruding from bottom surface 121 to be disposed at a side of first side surface 123 with respect to the center of bottom surface 121, and allows first terminal 14 out of first terminal 14 and second terminal 15 protruding from bottom surface 121 to be disposed at a side of second side surface 124 with respect to the center of bottom surface 121 in a direction connected between first side surface 123 and second side surface 124 of magnetic core 113 of inductor component 11. This configuration increases the creeping length between first terminal 14 and second terminal 15 and increases electric resistance of the surface, therefore improving insulation withstand voltage between first terminal 14 and second terminal 15.

Terminal base molding recess parts (molding recess parts) 186 and 187 having second terminal pocket 191*a* and second terminal pocket 191*b* therein that are locally in the extending direction of second terminal pocket 191*a* and second terminal pocket 191*b* are provided in first inner die wall 169.

Terminal base molding recess parts 186 and 187 are provided on lower die 163 and upper die 164 separately. When lower die 163 and upper die 164 are closed, terminal base molding recess parts 186 and 187 have tip portions 186*a* and 187*a*, bottom surfaces 186*b* and 187*b*, and side surfaces 186*c* and 187*c*, respectively. Tip portions 186*a* and 187*a* of the terminal base molding recess parts is provided in the extending direction of second terminal pocket 191*a* and second terminal pocket 191*b*. Bottom surfaces 186*b* and 187*b* of the terminal base molding recess parts is provided at portions where first inner die wall 169 is recessed and opened. Side surfaces 186*c* and 187*c* of the terminal base molding recess parts are connected with tip portions 186*a* and 187*a* of the terminal base molding recess parts and bottom surfaces 186*b* and 187*b* of the terminal base molding recess parts, respectively.

An area of tip portion 186*a* of the terminal base molding recess part 186 is smaller than an area of bottom surface 186*b* of the terminal base molding recess part 186. Side surface 186*c* of the terminal base molding recess part connected with tip portion 186*a* of the terminal base molding recess part and bottom surface 186*b* of the terminal base molding recess part inclines, and the terminal base molding recess part has a truncated cone shape. Terminal base molding recess part 187 has the same structure as terminal base molding recess part 186.

Terminal base molding recess parts 188 and 189 have the same structure as terminal base molding recess parts 186 and 187 regarding first terminal pocket 190*a* and first terminal pocket 190*b*.

Terminal base molding recess parts 186, 187, 188, 189 molds first terminal-covering part 133 and second terminal-covering part 134 of inductor component 111. Angles formed by side surfaces 186*c* and 187*c* of the terminal base molding recess parts (molding recess parts) and first inner die wall 169 are matched to predetermined angles θG and θH as described above, so as to improve insulation withstand voltage between first terminal 14 and second terminal 15 of inductor component 111.

Next, cavity 168 of mold die set 161 is filled with coil 12 and the mixture of magnetic metal powder, such as iron-silicon-chromium, and insulative thermosetting resin binder, such as silicone resin.

The magnetic metal powder and the binder are mixed such that the binder covers particles of the magnetic metal powder. The mixture is granulated, and the granules fill cavity 168.

Figure 20:
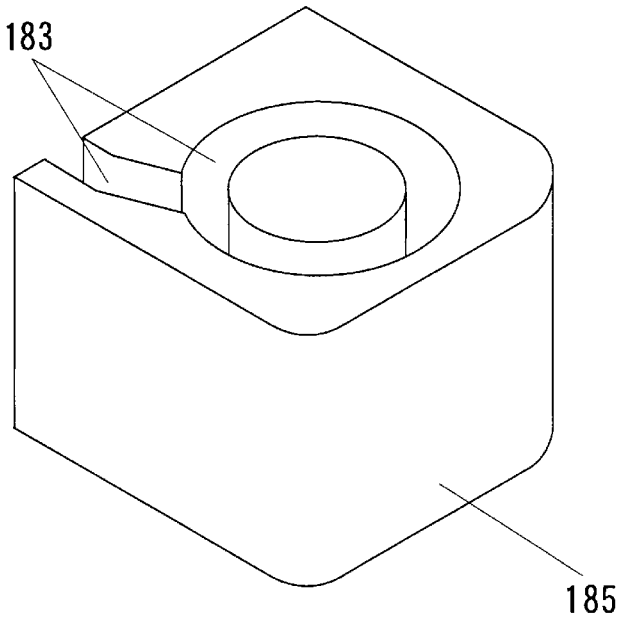
FIG. 20 illustrates a process for manufacturing processes of the inductor component in accordance with the second exemplary embodiment of the present disclosure.
Figure 21:
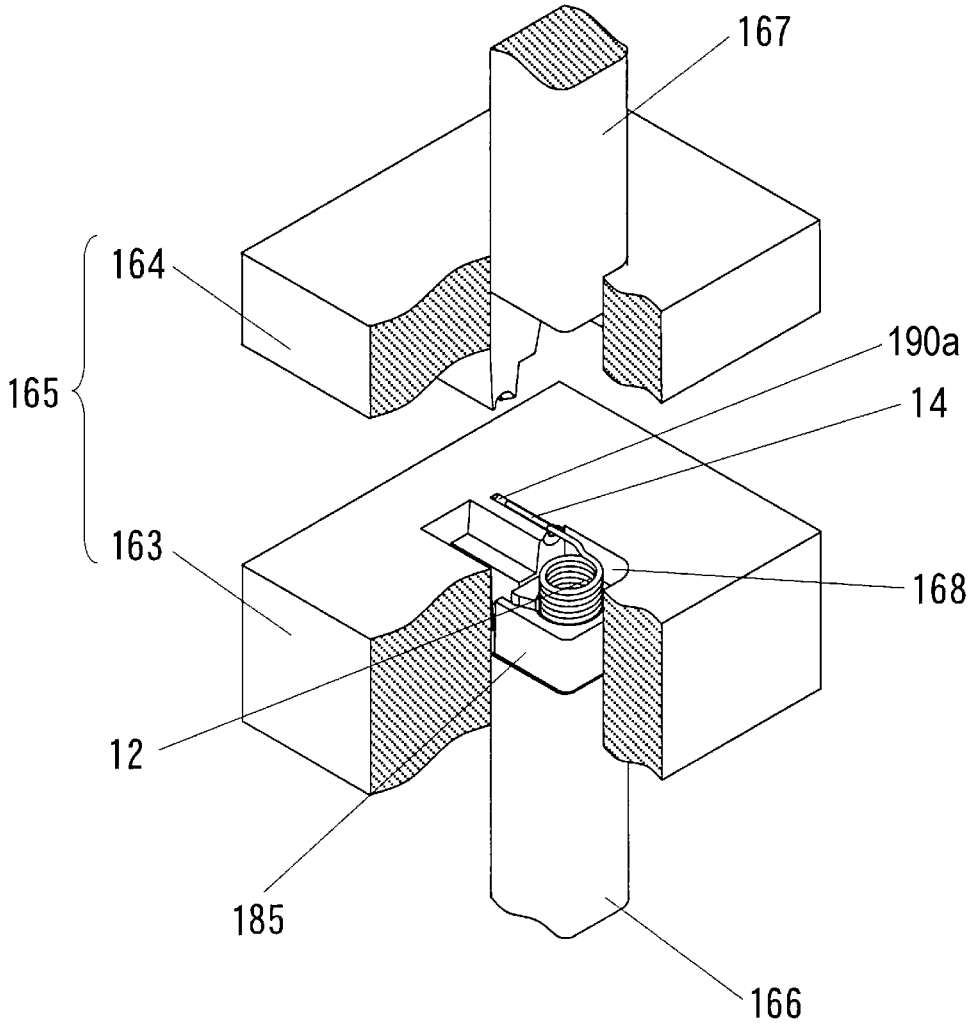
FIG. 21 illustrates a process for manufacturing the inductor component in accordance with the second exemplary embodiment of the present disclosure.
Figure 22:
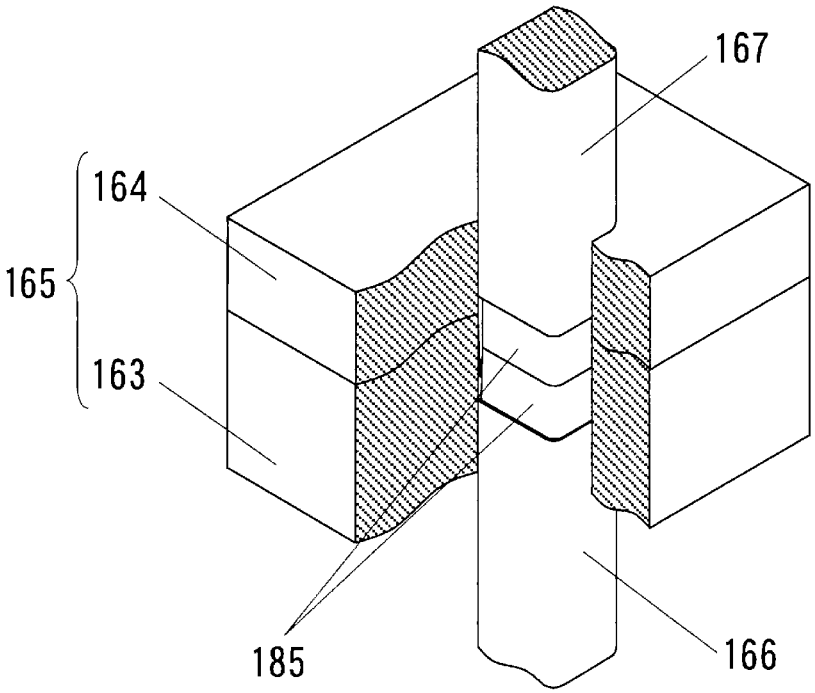
FIG. 22 illustrates a process for manufacturing the inductor component in accordance with the second exemplary embodiment of the present disclosure.
Figure 23:
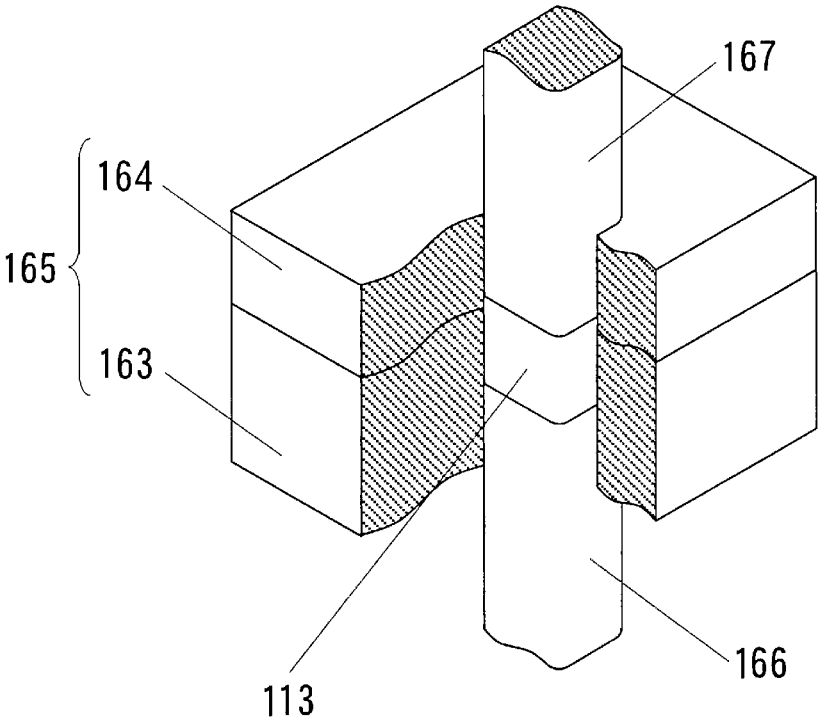
FIG. 23 illustrates a process for manufacturing the inductor component in accordance with the second exemplary embodiment of the present disclosure.
Figure 24:
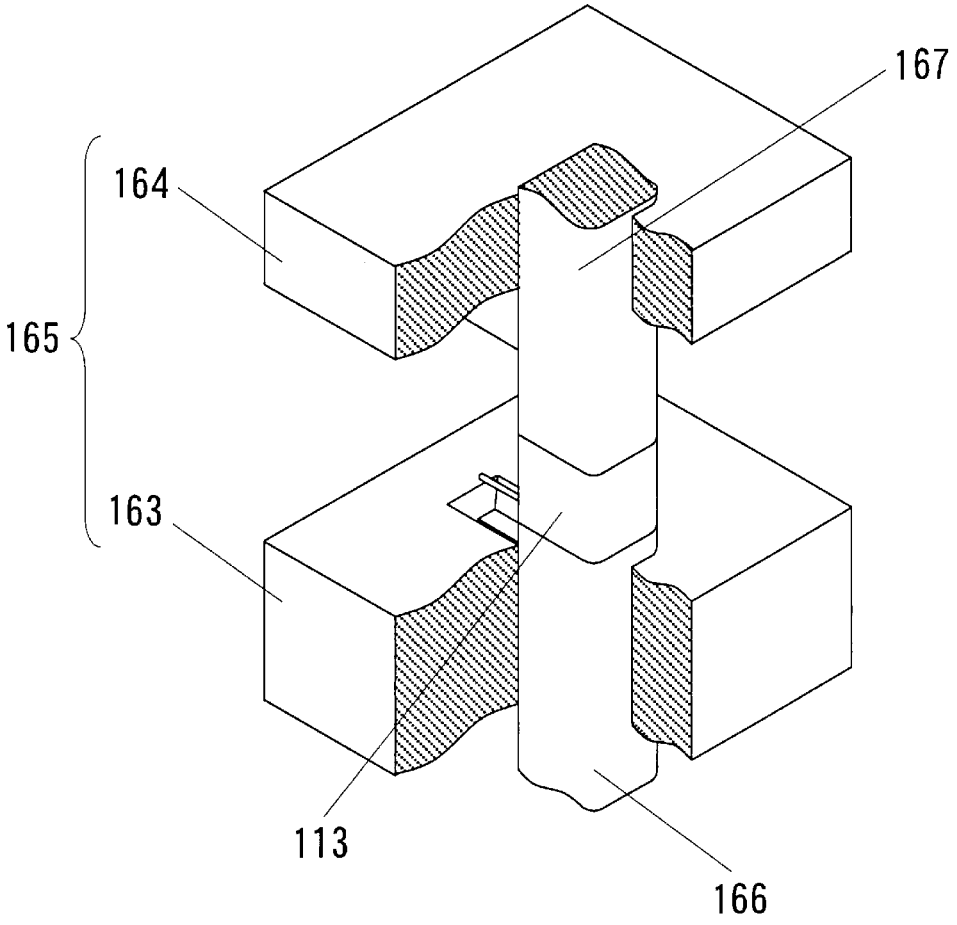
FIG. 24 illustrates a process for manufacturing the inductor component in accordance with the second exemplary embodiment of the present disclosure.
Figure 25:
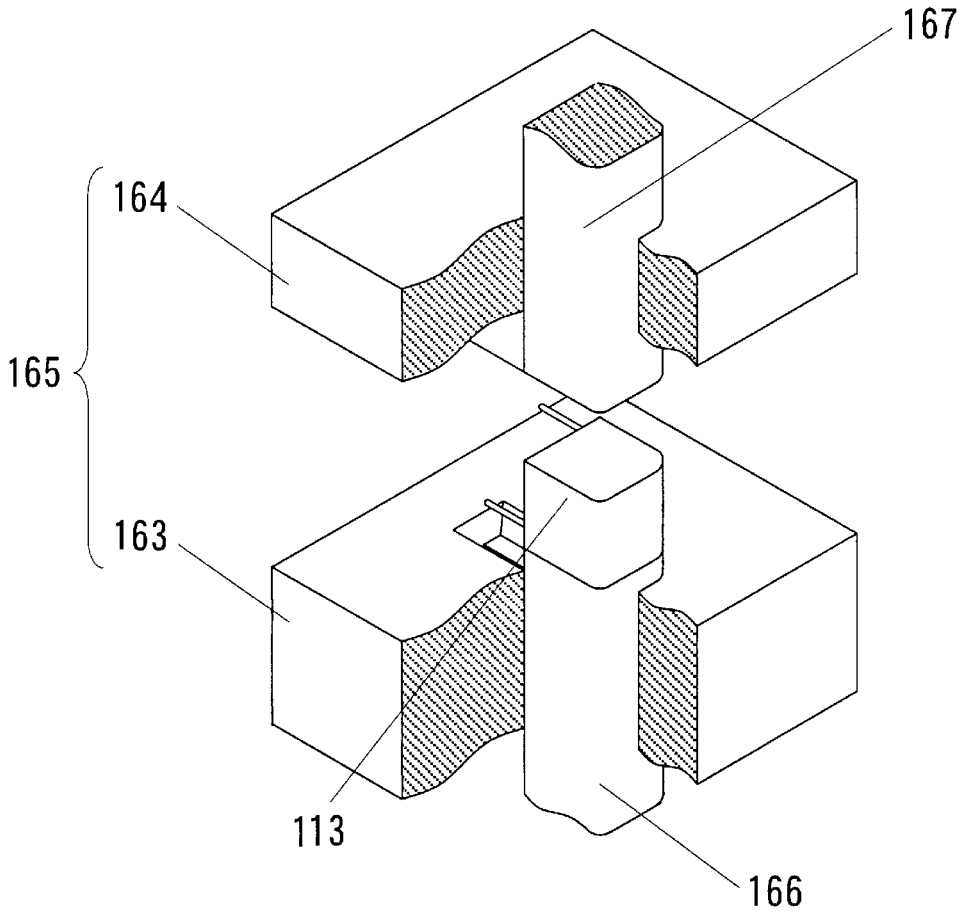
FIG. 25 illustrates a process for manufacturing the inductor component in accordance with the second exemplary embodiment of the present disclosure.

The granules may fill cavity 168 as they are. However, as shown in FIG. 20, the granules may be pressed with a pressure of about 1 ton/cm$^2$ to have powder compact 185 having a rectangular-columnar shape. Powder compact 185 may fill cavity 58 such that two powder compacts 85 cover coil 12 from the top and bottom. This configuration preferably allows cavity 168 to be filled with the granules efficiently.

Processes illustrated in FIGS. 21 to 25 are identical to processes shown in FIGS. 9 to 13 in accordance with the first exemplary embodiment, and thus detailed description for FIGS. 21 to 25 is omitted here.

The first exemplary embodiment and the second exemplary embodiment may be combined as required.

INDUSTRIAL APPLICABILITY

An inductor component and its manufacturing method of the present disclosure are effectively applicable to inductor components with a coil embedded in the magnetic core and supporting through-hole mounting. A withstand voltage between terminals of the inductor component can be improved to allow a broader use of inductor components.

REFERENCE MARKS IN DRAWINGS

11, 111 inductor component 12 coil 13, 113 magnetic core 14 first terminal 15 second terminal 21, 121 bottom surface 22 top surface 23, 123 first side surface 24, 124 second side surface 25 third side surface 26 side surface 31 recess 32, 132 high resistance area 41 first recess inner bottom surface 42 second recess inner bottom surface 43 third recess inner bottom surface 44 fourth recess inner bottom surface 45 first recess inner side surface 46 second recess inner side surface 47 third recess inner side surface 48 fourth recess inner side surface 49 fifth recess inner side surface 50 sixth recess inner side surface 51 seventh recess inner side surface 52 eighth recess inner side surface 61, 161 mold die set 62, 162 through-hole 63, 163 lower die (first die) 64, 164 upper die (second die) 65, 165 die unit 66, 166 lower punch (first punch) 67, 167 upper punch (second punch) 68, 168 cavity 69, 169 first inner die wall 70, 170 second inner die wall 71, 171 third inner die wall 72*a*, 172*a* first surface (first parting surface) 72*b*, 172*b* second surface (first parting surface) 90*a*, 90*b*, 190*a*, 190*b* first terminal pocket 91*a*, 91*b*, 191*a*, 191*b* second terminal pocket 74, 174 upper die fitting projection 75, 75 lower die fitting recess 76 protrusion 77*a*, 177*a* second parting surface 78*a* 78*b*, 178*a*, 178*b* third parting surface 79*a*, 79*b*, 179*a*, 179*b* fourth parting surface 80*a*, 180*a* fifth parting surface (third surface) 80*b*, 180*b* fifth parting surface (fourth surface) 81*a*, 81*b*, 181*a*, 181*b* sixth parting surface 82 insertion groove 83, 183 housing recess 84*v* insertion groove 85, 185 powder compact 133 first terminal-covering part 134 second terminal-covering part 133*a* tip portion of the first terminal-covering part 133*b* bottom surface of the first terminal-covering part 133*c* side surface of the first terminal-covering part 134*a* tip portion of the second terminal-covering part 134*b* bottom surface of the second terminal-covering part 134*c* side surface of the second terminal-covering part 186, 187, 188, 189 terminal base molding recess part 186*a*, 187*a* tip portion of the terminal base molding recess part 186*b*, 187*b* bottom surface of the terminal base molding recess part 186*c*, 187*c* side surface of the terminal base molding recess part

The invention claimed is:

1. An inductor component comprising:

a coil including a wound conductive wire;

a magnetic core having the coil embedded therein, the magnetic core being made of magnetic metal powder and a binder made of insulation resin, the magnetic core having a bottom surface, a top surface opposite to the bottom surface, a first side surface connected with the bottom surface and the top surface, a second side surface opposite to the first side surface, a third side surface connected with the first side surface and the second side surface, and a fourth side surface opposite to the third side surface, the first side surface being perpendicular to the bottom surface; and a first terminal and a second terminal each extending from respective one of both ends of the coil and protruding from the bottom surface, wherein the magnetic core includes a terminal-covering part protruding from the bottom surface, the terminal-covering part covering at least one of respective base parts of the first terminal and the second terminal, and wherein an area of a tip portion of the terminal-covering part is smaller than an area of a bottom surface of the terminal-covering part, and the terminal-covering part has a truncated cone shape having a side surface connected with the tip portion and the bottom surface of the terminal-covering part.

2. The inductor component of claim 1, wherein a recess is provided in the bottom surface between the first terminal and the second terminal, and reaches the first side surface and the second side surface.

3. The inductor component of claim 2, wherein the first terminal is provided at a position closer to the second side surface than to the first side surface, and the second terminal is provided at a position closer to the first side surface than to the second side surface.

4. The inductor component of claim 2, wherein an electric resistance of a region of an inner surface of the recess is higher than an electric resistance of a surface of the bottom surface other than the recess.

5. The inductor component of claim 1, wherein the first terminal is provided at a position closer to the second side surface than to the first side surface, and the second terminal is provided at a position closer to the first side surface than to the second side surface.

6. An inductor component comprising:

a coil including a wound conductive wire;

a magnetic core having the coil embedded therein, the magnetic core being made of magnetic metal powder and a binder made of insulation resin, the magnetic core having a bottom surface, a top surface opposite to the bottom surface, a first side surface connected with the bottom surface and the top surface, a second side surface opposite to the first side surface, a third side surface connected with the first side surface and the second side surface, and a fourth side surface opposite to the third side surface, the first side surface being perpendicular to the bottom surface; and a first terminal and a second terminal each extending from respective one of both ends of the coil and protruding from the bottom surface, wherein a recess is provided in the bottom surface between the first terminal and the second terminal, and reaches the first side surface and the second side surface, and wherein a depth of the recess from the bottom surface of the magnetic core increases as shifting toward the first side surface from a center of the bottom surface between the first side surface and the second side surface, and increases as shifting toward the second side surface from the center of the bottom surface between the first side surface and the second side surface.

7. The inductor component of claim 6, wherein a width of the recess along the bottom surface of the magnetic core increases as shifting toward the first side surface from the center of the bottom surface between the first side surface and the second side surface, and increases as shifting toward the second side surface from the center of the bottom surface between the first side surface and the second side surface.

8. The inductor component of claim 6, wherein the first terminal is provided at a position closer to the second side surface than to the first side surface, and the second terminal is provided at a position closer to the first side surface than to the second side surface.

9. The inductor component of claim 6, wherein an electric resistance of a region of an inner surface of the recess is higher than an electric resistance of a surface of the bottom surface other than the recess.

10. An inductor component comprising:

a coil including a wound conductive wire;

a magnetic core having the coil embedded therein, the magnetic core being made of magnetic metal powder and a binder made of insulation resin, the magnetic core having a bottom surface, a top surface opposite to the bottom surface, a first side surface connected with the bottom surface and the top surface, a second side surface opposite to the first side surface, a third side surface connected with the first side surface and the second side surface, and a fourth side surface opposite to the third side surface, the first side surface being perpendicular to the bottom surface; and a first terminal and a second terminal each extending from respective one of both ends of the coil and protruding from the bottom surface, wherein a recess is provided in the bottom surface between the first terminal and the second terminal, and reaches the first side surface and the second side surface, and wherein a width of the recess along the bottom surface of the magnetic core increases as shifting toward the first side surface from a center of the bottom surface between the first side surface and the second side surface, and increases as shifting toward the second side surface from the center of the bottom surface between the first side surface and the second side surface.

11. The inductor component of claim 10, wherein the first terminal is provided at a position closer to the second side surface than to the first side surface, and the second terminal is provided at a position closer to the first side surface than to the second side surface.

12. The inductor component of claim 10, wherein an electric resistance of a region of an inner surface of the recess is higher than an electric resistance of a surface of the bottom surface other than the recess.

* * * * *